US010684063B2

(12) United States Patent
Querfurth et al.

(10) Patent No.: US 10,684,063 B2
(45) Date of Patent: Jun. 16, 2020

(54) EASY OPEN DRAWER/DOOR WITH ROTATING HANDLE

(71) Applicant: WHIRLPOOL CORPORATION, Benton Harbor, MI (US)

(72) Inventors: Karen J. Querfurth, Coloma, MI (US); Pendyala Supreeth, Pune (IN); Michele Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 477 days.

(21) Appl. No.: 15/376,159

(22) Filed: Dec. 12, 2016

(65) Prior Publication Data

US 2017/0184337 A1 Jun. 29, 2017

Related U.S. Application Data

(60) Provisional application No. 62/271,451, filed on Dec. 28, 2015.

(51) Int. Cl.
*F25D 23/02* (2006.01)
*E05F 11/16* (2006.01)
(Continued)

(52) U.S. Cl.
CPC ..... *F25D 23/028* (2013.01); *E05B 7/00* (2013.01); *E05B 17/0033* (2013.01); *E05B 53/005* (2013.01); *E05F 11/16* (2013.01); *F25D 11/02* (2013.01); *F25D 23/021* (2013.01); *F25D 25/025* (2013.01); *E05Y 2201/68* (2013.01); *E05Y 2900/31* (2013.01)

(58) Field of Classification Search
CPC .... F25D 23/028; F25D 23/021; F25D 25/025; E05B 17/0033; E05B 7/00
See application file for complete search history.

(56) References Cited

U.S. PATENT DOCUMENTS 2,659,115 A 11/1953 Anderson et al.
2,810,493 A 10/1957 Eichhorn et al.
(Continued)

FOREIGN PATENT DOCUMENTS

CN 201165778 Y 12/2008
CN 101871716 A 10/2010
(Continued)

OTHER PUBLICATIONS

European Patent Office, European Search Report for Application No. EP16204554.6-1605, dated May 2, 2017, 8 pages.

*Primary Examiner* — Kimberly S Wright
(74) *Attorney, Agent, or Firm* — Price Heneveld LLP

(57) ABSTRACT

A refrigerator includes a refrigerator body having an interior storage space. A door is coupled to the refrigerator body to open and close the interior storage space. A door handle is coupled to the door in a pivotally rotatable manner and an opening actuator is coupled to the door handle where the opening actuator applies a force to the refrigerator body to open the interior storage space. The opening actuator includes a front bezel, a handle pivot plate coupled to the door handle, a casing enclosing an actuator mechanism, and one or more pushers that extend and retract against a front wrapper edge of the refrigerator body. An intermediate attachment couples the handle pivot plate to the casing and a back bezel.

8 Claims, 22 Drawing Sheets

(51) Int. Cl.

| | |
|---|---|
| ***F25D 11/02*** | (2006.01) |
| ***F25D 25/02*** | (2006.01) |
| ***E05B 17/00*** | (2006.01) |
| ***E05B 7/00*** | (2006.01) |
| ***E05B 53/00*** | (2006.01) |

(56) References Cited

U.S. PATENT DOCUMENTS 5,579,606 A 12/1996 Kim
5,908,228 A 6/1999 Lee
5,915,805 A 6/1999 Lee
6,375,291 B1 4/2002 Nam et al.
6,655,765 B2 12/2003 Kawamura et al.
6,746,091 B2 * 6/2004 Friar ..... A61G 12/001 312/218
6,811,236 B1 11/2004 Spong et al.
6,957,979 B2 * 10/2005 Welsh ..... H05K 7/1409 439/545
7,036,499 B2 * 5/2006 Bartmann ..... E05B 7/00 126/191
7,261,100 B2 * 8/2007 Bartmann ..... F24C 15/023 126/192
7,445,005 B2 * 11/2008 Bartmann ..... E05B 7/00 126/192
7,448,705 B2 11/2008 Park
7,458,132 B2 12/2008 Kwon
7,556,324 B2 7/2009 Benz
7,665,335 B2 2/2010 Stuckey
7,765,645 B2 8/2010 Kim
7,901,019 B2 3/2011 Laundroche et al.
7,918,492 B2 * 4/2011 Elliott ..... B60J 5/06 296/146.12
7,871,113 B2 7/2011 Watanabe et al.
7,975,351 B2 7/2011 King
7,984,955 B2 7/2011 Jung et al.
8,020,548 B2 * 9/2011 Bartmann ..... F24C 15/023 126/192
8,025,349 B2 * 9/2011 Lim ..... E05B 17/0033 16/412
8,096,040 B2 * 1/2012 Wing ..... F25D 23/028 16/412
8,099,970 B2 1/2012 Cho et al.
8,277,005 B2 10/2012 Jung et al.
8,297,725 B2 10/2012 Kim et al.
8,328,301 B2 12/2012 Lee et al.
8,398,185 B2 3/2013 Seo
8,506,028 B2 * 8/2013 Lim ..... E05B 17/0033 16/412
8,516,659 B2 8/2013 Wing
8,523,302 B2 9/2013 Shin et al.
9,046,296 B2 * 6/2015 Wing ..... F25D 23/028
9,127,879 B2 9/2015 Hwang et al.
9,777,523 B2 * 10/2017 Choi ..... E05D 15/04
10,145,163 B2 * 12/2018 Choi ..... E05F 11/54
10,161,669 B2 * 12/2018 Naik ..... F25D 23/028
2003/0102784 A1 * 6/2003 Friar ..... A61G 12/001 312/218
2005/0023945 A1 * 2/2005 Bartmann ..... F24C 15/026 312/319.2
2005/0023946 A1 * 2/2005 Bartmann ..... F24C 15/023 312/328
2005/0134158 A1 * 6/2005 Bartmann ..... F24C 15/023 312/319.2
2005/0200253 A1 9/2005 Wissinger et al.
2006/0021284 A1 2/2006 Benz
2006/0022563 A1 2/2006 Huruoka
2008/0000052 A1 1/2008 Hong et al.
2008/0282505 A1 11/2008 Kim
2009/0205357 A1 * 8/2009 Lim ..... E05B 17/0033 62/441
2009/0282651 A1 11/2009 Yang
2011/0215691 A1 * 9/2011 Keskin ..... A47L 15/4261 312/319.2
2011/0297686 A1 * 12/2011 Lim ..... E05B 17/0033 220/592.09
2012/0061405 A1 3/2012 Kwon
2012/0280608 A1 * 11/2012 Park ..... E05B 1/0015 312/405
2013/0270990 A1 10/2013 Park et al.
2014/0035453 A1 * 2/2014 Kwon ..... A47B 95/02 312/325
2014/0230483 A1 8/2014 Kempfle
2014/0319989 A1 10/2014 Hwang et al.
2015/0167347 A1 * 6/2015 Park ..... E05B 85/16 16/412
2015/0292793 A1 * 10/2015 Bischoff ..... F25D 23/028 312/404
2016/0076289 A1 * 3/2016 Choi ..... E05D 15/04 312/326

FOREIGN PATENT DOCUMENTS

CN 102269508 A 12/2011
CN 202166266 A 3/2012
CN 102538353 A 7/2012
CN 202393139 U 8/2012
CN 202467332 U 10/2012
CN 102980357 A 3/2013
CN 102980358 A 3/2013
CN 103017440 A 4/2013
CN 103148663 A 6/2013
CN 103162500 A 6/2013
CN 103528320 A 1/2014
CN 203412364 U 1/2014
CN 203605598 U 5/2014
CN 104047940 A 9/2014
CN 102661082 B 10/2014
CN 203961440 U 11/2014
DE 19906659 A1 8/2000
DE 102013103821 A1 10/2014
EP 1524483 A1 4/2005
EP 2520885 A2 11/2012
EP 2527749 A1 11/2012
EP 2741015 A2 6/2014
JP 2000205740 A 7/2000
JP 2000279283 A 10/2000
JP 2004245491 A 9/2004
JP 2005127656 A 5/2005
JP 2005299314 A 10/2005
JP 2007321531 A 12/2007
JP 2010261675 A 11/2010
JP 2012047347 A 3/2012
JP 2013113019 A 6/2013
JP 2013117332 A 6/2013
KR 20090091632 A 8/2009
KR 20100101899 A 9/2010
KR 20120124693 A 11/2012
KR 20130087321 A 8/2013
WO 03106904 A1 12/2003
WO 2004104332 A1 12/2004
WO 2005057106 A1 6/2005
WO 2007131554 A1 11/2007
WO 2012007217 A1 1/2012
WO 2012110291 A2 8/2012
WO 2014194952 A1 12/2014
WO 2014194953 A1 12/2014
WO 2014194955 A1 12/2014
WO 2015043479 A1 4/2015

* cited by examiner

EASY OPEN DRAWER/DOOR WITH ROTATING HANDLE

CROSS-REFERENCE TO RELATED APPLICATION

This application claims priority under 35 U.S.C. § 119(e) to U.S. Provisional Patent Application No. 62/271,451, filed Dec. 28, 2015, entitled "EASY OPEN DRAWER/DOOR WITH A ROTATING HANDLE," which is herein incorporated by reference in its entirety.

FIELD OF THE DISCLOSURE

The present disclosure relates to a refrigerator, and in particular, to a refrigerator that uses a handle to activate a pushing device installed on a drawer or door of a refrigerator by using a mechanism to transfer movement from the handle to the pushing device to separate the door from the refrigerator main body.

BACKGROUND

A refrigerator is an apparatus for storing foods or other materials at low temperatures to preserve the food or material in a refrigerated or frozen state according to the type and condition of desired preservation. Depending on the type of refrigerator, various types of doors for opening and closing the cabinet space are used. These doors typically have a graspable handle installed to allow a user to more easily open and close the door by grasping the door handle and pivoting the door to selectively open and close the cabinet space.

When a user grasps a door handle to open the cabinet space of a refrigerator, a pulling force must be exerted that is sufficient enough to release the coupling force between the gasket of the door and the main body of the refrigerator. The seal of the door gasket along the main body is often increased because of the drop in pressure within the refrigerator due to temperature differences so that the door and the main body are pressed and/or sealed more firmly together. In many instances, the weight and seal of the refrigerator door to the main body can make the act of opening the door difficult or inconvenient for some users.

BRIEF SUMMARY OF THE DISCLOSURE

According to one aspect of the present disclosure, a refrigerator is provided. The refrigerator includes a refrigerator body having an interior storage space, a door coupled to the refrigerator body to open and close the interior storage space, a door handle coupled to the door in a pivotally rotatable manner, and an opening actuator coupled to the door handle wherein the opening actuator applies a force to the refrigerator body to open the interior storage space. The opening actuator includes a front bezel, a pivot handle plate coupled to the door handle, a casing enclosing an actuator mechanism and one or more pushers that extend and retract against a front wrapper side of the refrigerator body, an intermediate attachment coupling the pivot handle plate to the casing, and a back bezel.

According to a second aspect of the present disclosure, a door opening actuator for actuator for a refrigerator is provided. The door opening actuator includes a front bezel, a pivot handle plate, an intermediate attachment, a casing, and a back bezel. A door handle includes a grip portion coupled to the opening actuator through the pivot handle plates. The casing encloses an actuator mechanism that extends and retracts a pusher against a front wrapper side of the refrigerator to open a door pivotally coupled to the refrigerator to open and close an interior space.

According to a third aspect of the present disclosure, a method for installing an opening actuator in a refrigerator door is provided. The method includes determining a distance between a pair of mounting holes on a door handle, determining a mounting profile for the door handle, selecting a casing providing the desired distance between the pair of mounting holes on the door handle, selecting a pivot handle plate that can be coupled to the mounting profile of the door handle, selecting a front bezel and an intermediate attachment to couple with the pivot handle plate and casing, coupling the door handle to the pivot handle plate, and coupling the front bezel and the intermediate attachment to the door handle and the casing. An actuator mechanism extends and retracts a pusher against a front cabinet wrapper side of the refrigerator.

These and other features, advantages, and objects of the present invention will be further understood and appreciated by those skilled in the art by reference to the following specification, claims, and appended drawings.

DETAILED DESCRIPTION

As required, detailed embodiments of the present disclosure are disclosed herein. However, it is to be understood that the disclosed embodiments are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

Figure 1:
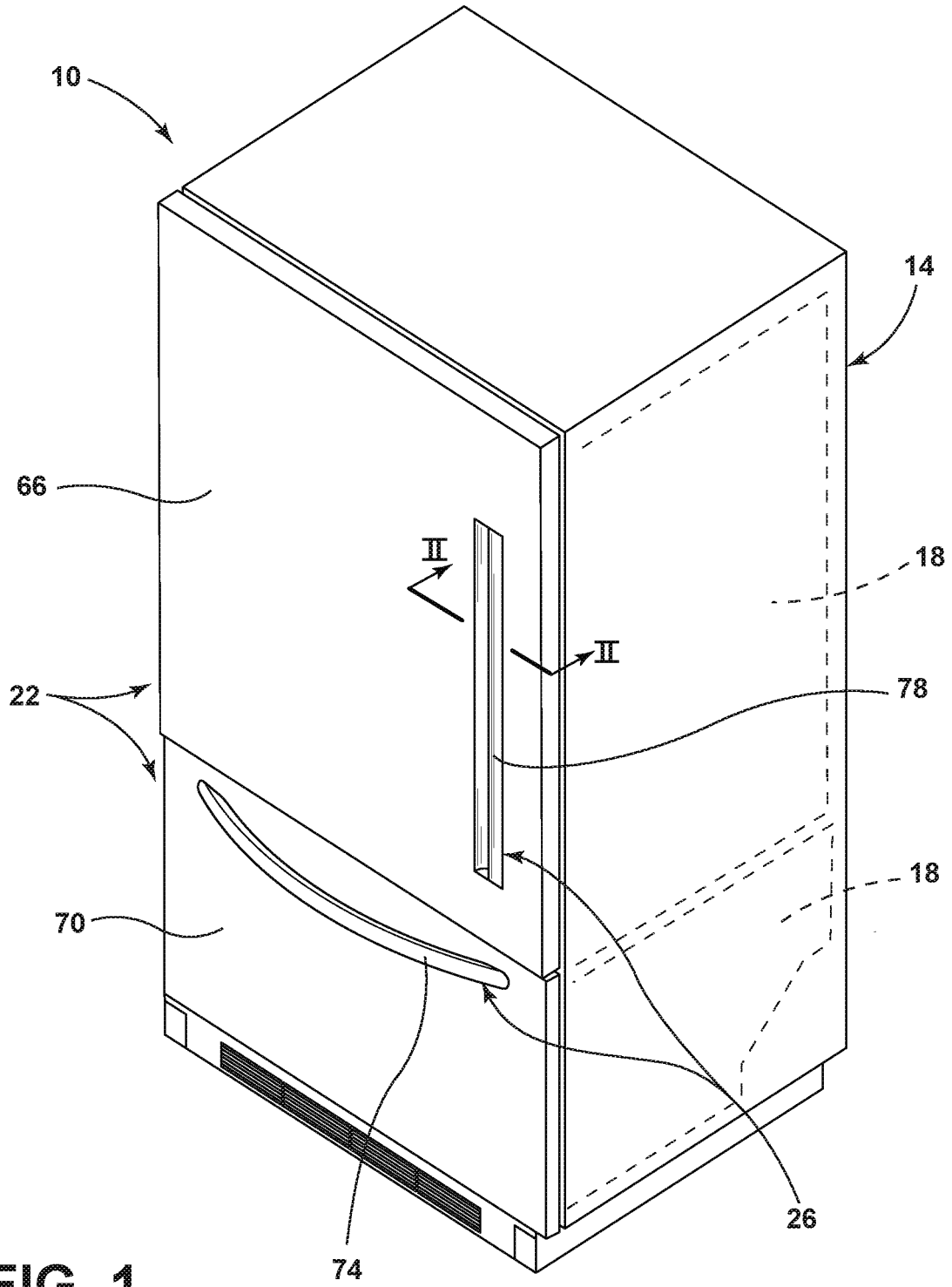
FIG. 1 is a perspective view of a refrigerator according to one aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-23, a refrigerator 10 includes a refrigerator body 14 having an interior storage space 18. A door 22 is coupled to the refrigerator body 14 to open and close the interior storage space 18. A door handle 26 is coupled to the door 22 in a pivotally rotatable manner and an opening actuator 30 is coupled to the door handle 26 where the opening actuator 30 applies a force to the refrigerator body 14 to open the interior storage space 18. The opening actuator 30 includes a front bezel 34, a pivot handle plate 38 coupled to the door handle 26, a casing 42 enclosing an actuator mechanism 46, and a pusher arm 50 that extends and retracts against a front wrapper side 54 of the refrigerator body 14. An intermediate attachment 58 couples the pivot handle plate 38 to the casing 42 and a back bezel 62.

Referring now to FIG. 1, the refrigerator 10 has the refrigerator body 14 enclosing the interior storage spaces 18 and is pivotally or slidingly coupled to one or more doors 22. The term "door 22," as defined herein, includes a refrigerator door 66, a freezer door 70, a refrigerator drawer, a freezer drawer, and/or a crisper drawer. In some embodiments, the door 22 may be pulled out towards the user as shown by the freezer door/drawer 70. The door 22 has a door handle 26, which may include a protruding handle 74 and/or a pocket handle 78, to rotate and push/pull the door 22 open or closed so a user can access the interior storage space 18. The refrigerator 10 may include one or more doors 22 to access one or more interior storage spaces 18 which may include a refrigerator storage space or a freezer storage space. The doors 22 may optionally include an ice and/or water dispenser.

The refrigerator doors 66 and freezer doors 70 disclosed herein may be used in a variety of configurations including French door, side-by-side, top freezer, bottom freezer, counter depth, compact, built-in, single door refrigerator, single door freezer, and other types of refrigerators and/or freezers. The disclosure herein describing embodiments for any refrigerator and/or freezer door 70 applies equally as well to the other's application.

The refrigerator may have any of a known cooling system including a compressor, condenser, expansion valve, evaporator, conduits, and other related components (not shown). Alternatively, the refrigerator 10 may comprise thermoelectric components (not shown), or other suitable arrangements depending on the intended use.

Any reference to the opening actuator 30 being coupled to the door handle 26 to open the door 22 of the refrigerator 10 to access the interior storage space 18 may be also used to at least partially describe refrigerator/freezer drawers. The drawer may be coupled to the refrigerator body 14 or other structure located in the interior storage space 18 of the refrigerator 10. Some non-limiting examples of drawers may include a refrigerator drawer, a freezer drawer, and/or a pantry drawer. The description and each of the embodiments described below regarding the door 22 and door handle 26 may be substituted for drawer and drawer handle applications.

Figure 17:
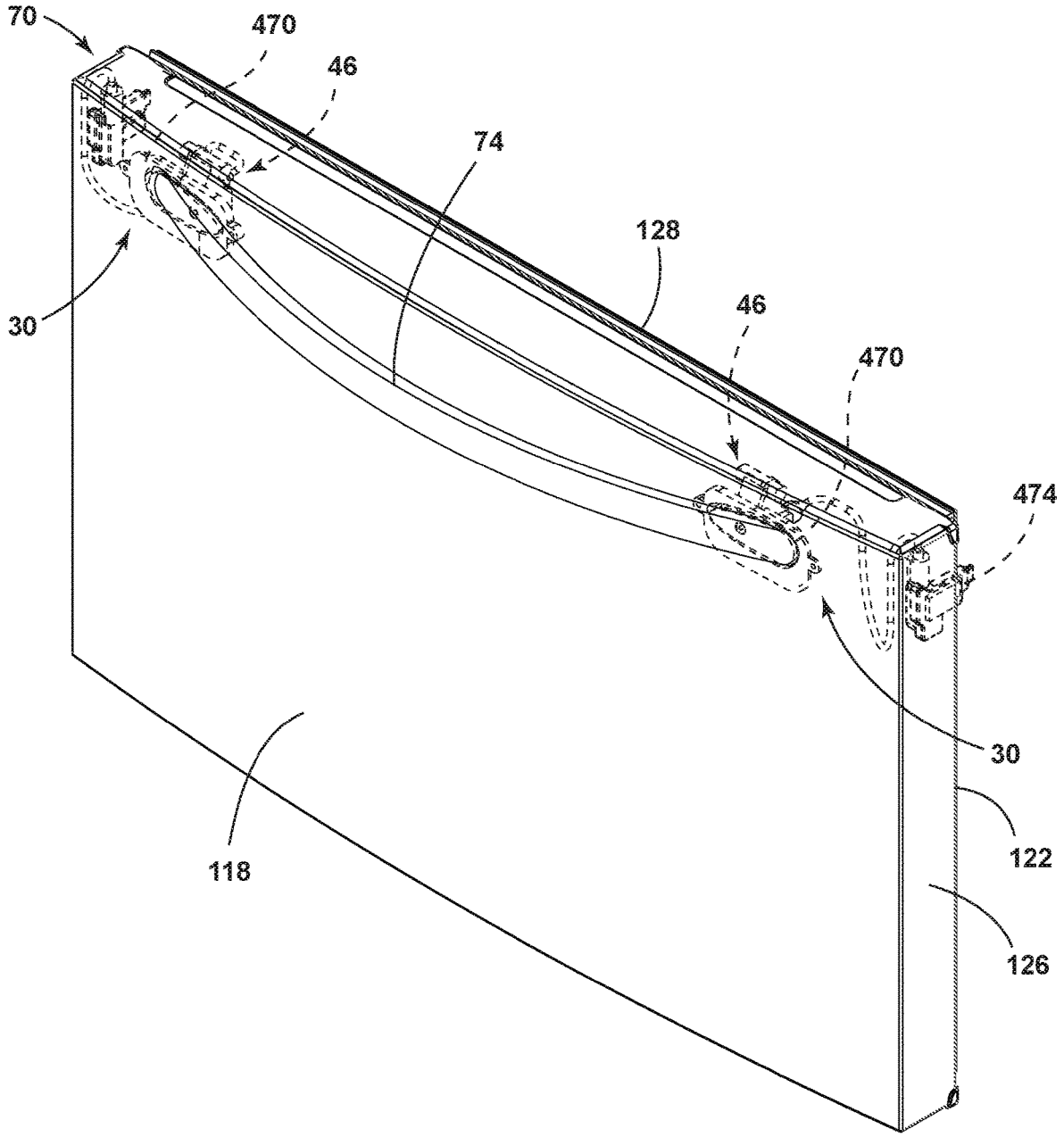
FIG. 17 is a front perspective of a protruding handle having an actuator mechanism using a sheathed cable mechanism using straight extending pusher arms.
Figure 18:
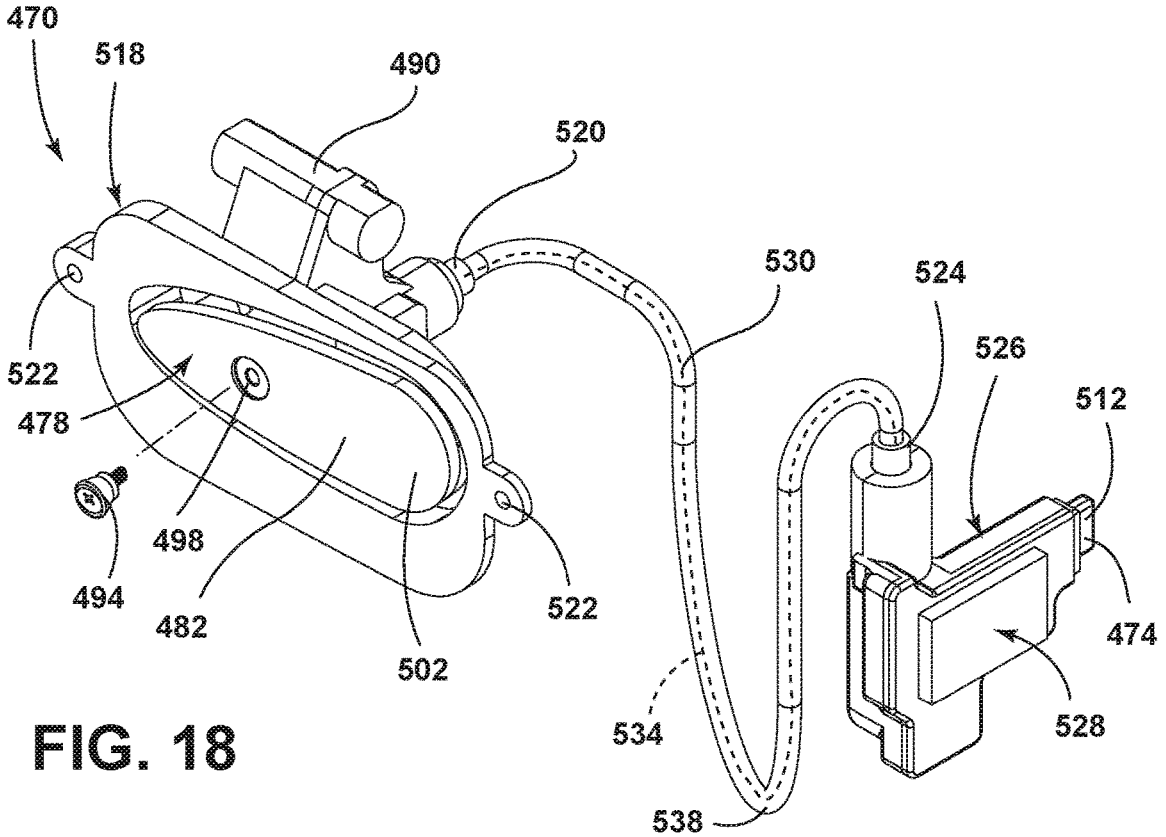
FIG. 18 is a front perspective of the sheathed cable mechanism having a retracted straight extending pusher arm.
Figure 19:
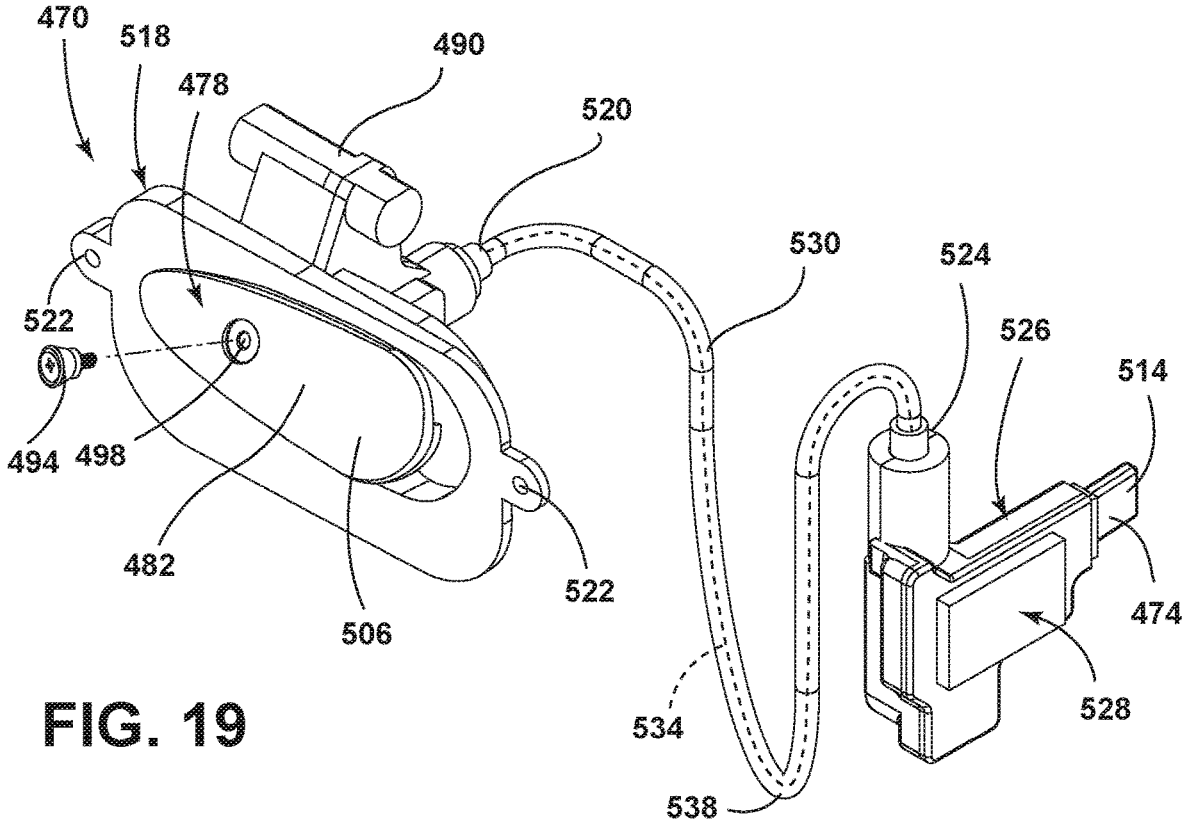
FIG. 19 is a front perspective of the sheathed cable mechanism having an extended straight extending pusher arm.

The opening actuator device 30 disclosed herein for an easy open drawer/door with a rotating handle is operated through a combination of three different components. The three different components contained in these devices are: 1) the type of door handle 26; 2) the type of actuator mechanism 46 to transfer movement from the door handle 26 to the pusher arm 50; and 3) the type of movement for the pusher arm 50. Regarding the first component, the door handle 26 may include the protruding handle 74 (FIGS. 5, 9, 13, 17, and 21A-21C) and/or the pocket handle 78 (FIGS. 2-4) to rotate and push/pull the door 22 open or closed so a user can access the interior storage space 18. For the second component, three different sample actuator mechanisms 46 are disclosed herein to transfer movement from the door handle 26 to the pusher: a Z lever mechanism (FIGS. 5-8 and 22-23); 2) a pulley mechanism (FIGS. 9-16); and 3) a sheathed cable mechanism (FIGS. 17-19). Regarding the third component, there are two examples for the types of pusher arm 50 movement described herein: the straight extending pusher arm (FIGS. 5-8, 13-19, and 22) and the rotating pusher arm (FIGS. 9-12). The various types of pusher arms 50 may extend out against the front wrapper side 54 of the refrigerator body 14 to break the seal of a gasket 128 (FIG. 5) around the edge of the door 22. In other embodiments, the various types of pusher arms 50 may extend out and push against a refrigerator liner (not shown) to break the seal of the gasket 128 around the edge of the door 22.

Figure 2:
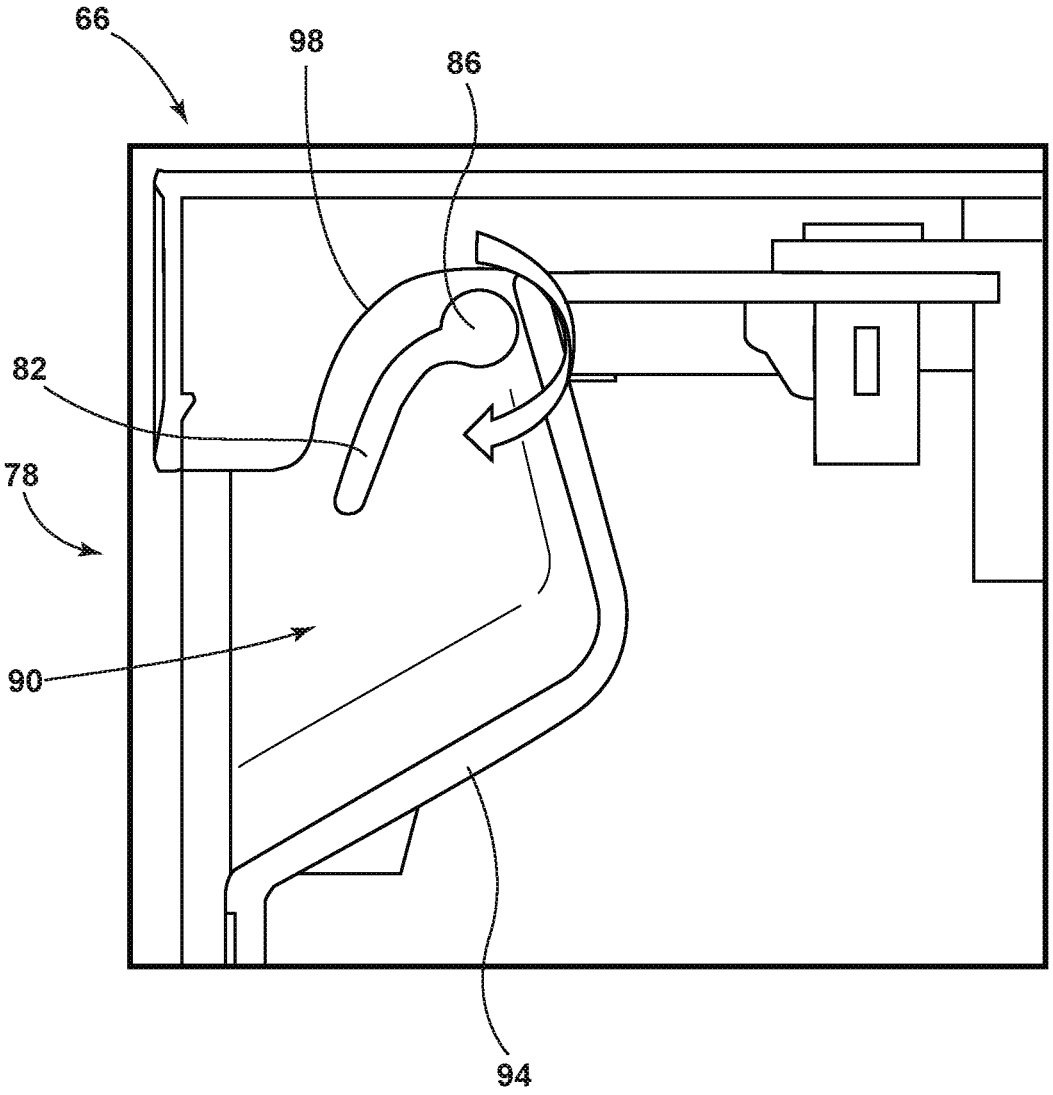
FIG. 2 is a cross-sectional view of a pocket handle having a top actuation.
Figure 3:
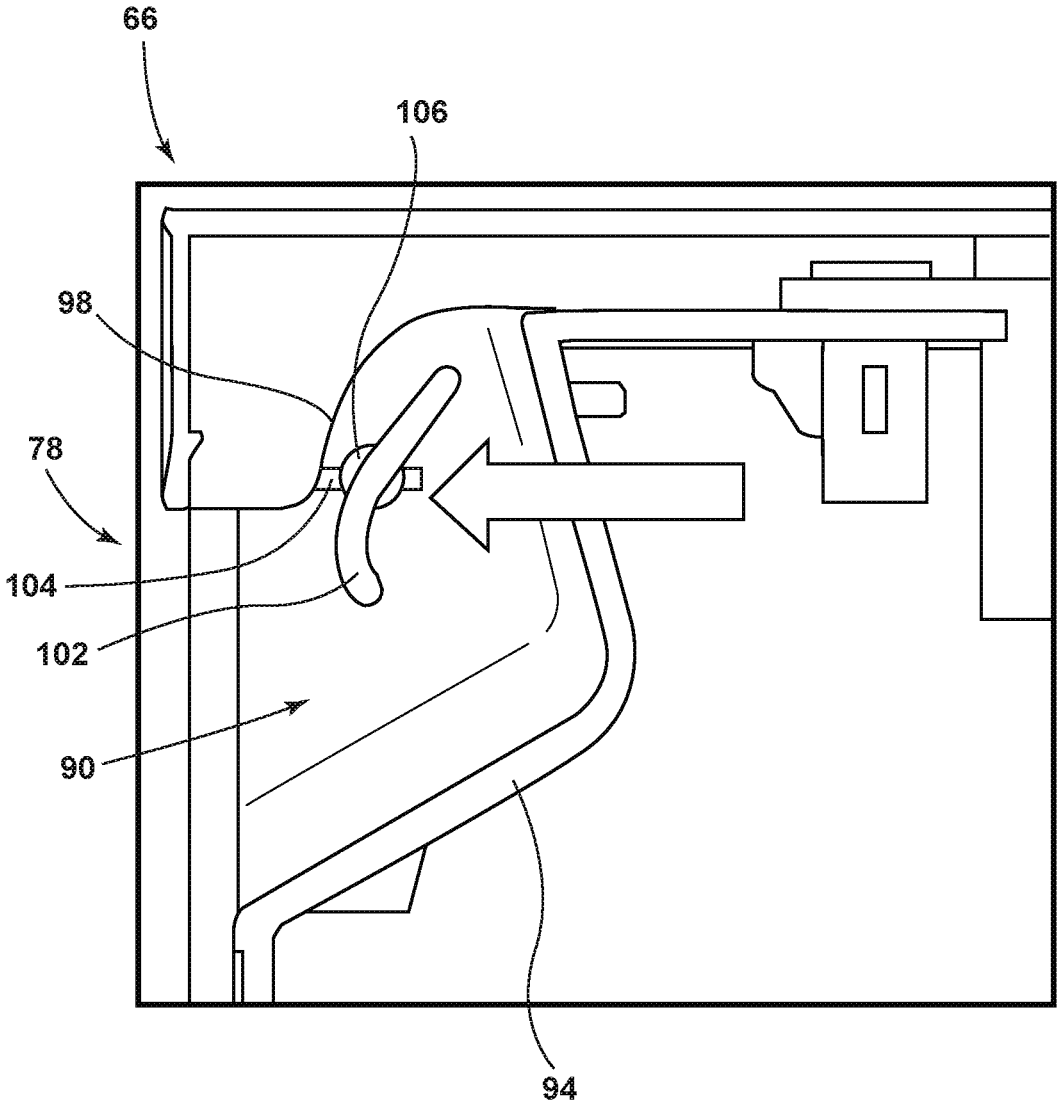
FIG. 3 is a cross-sectional view of a pocket handle having a linear actuation.
Figure 4:
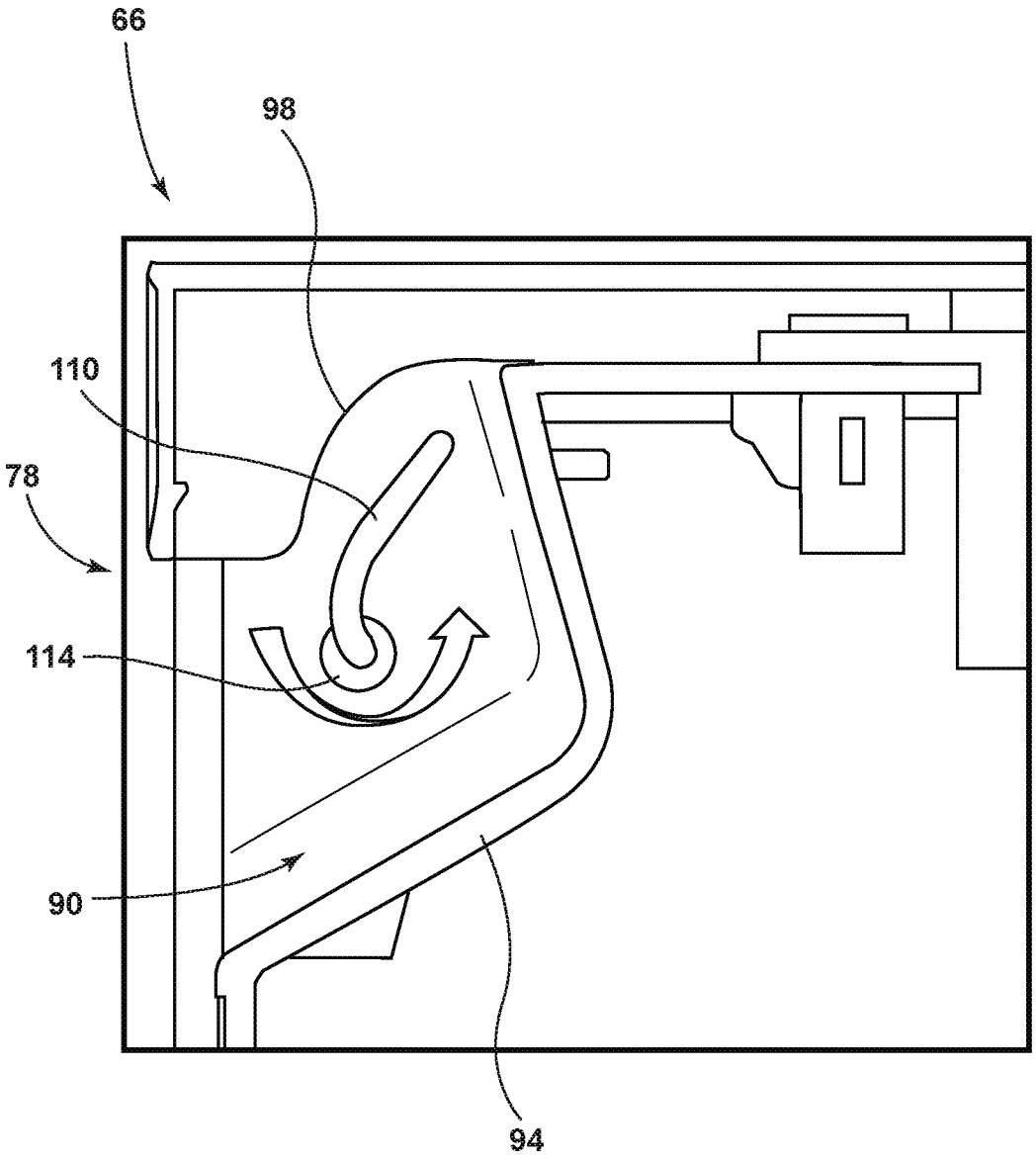
FIG. 4 is a cross-sectional view of a pocket handle having a bottom actuation.
Figure 5:
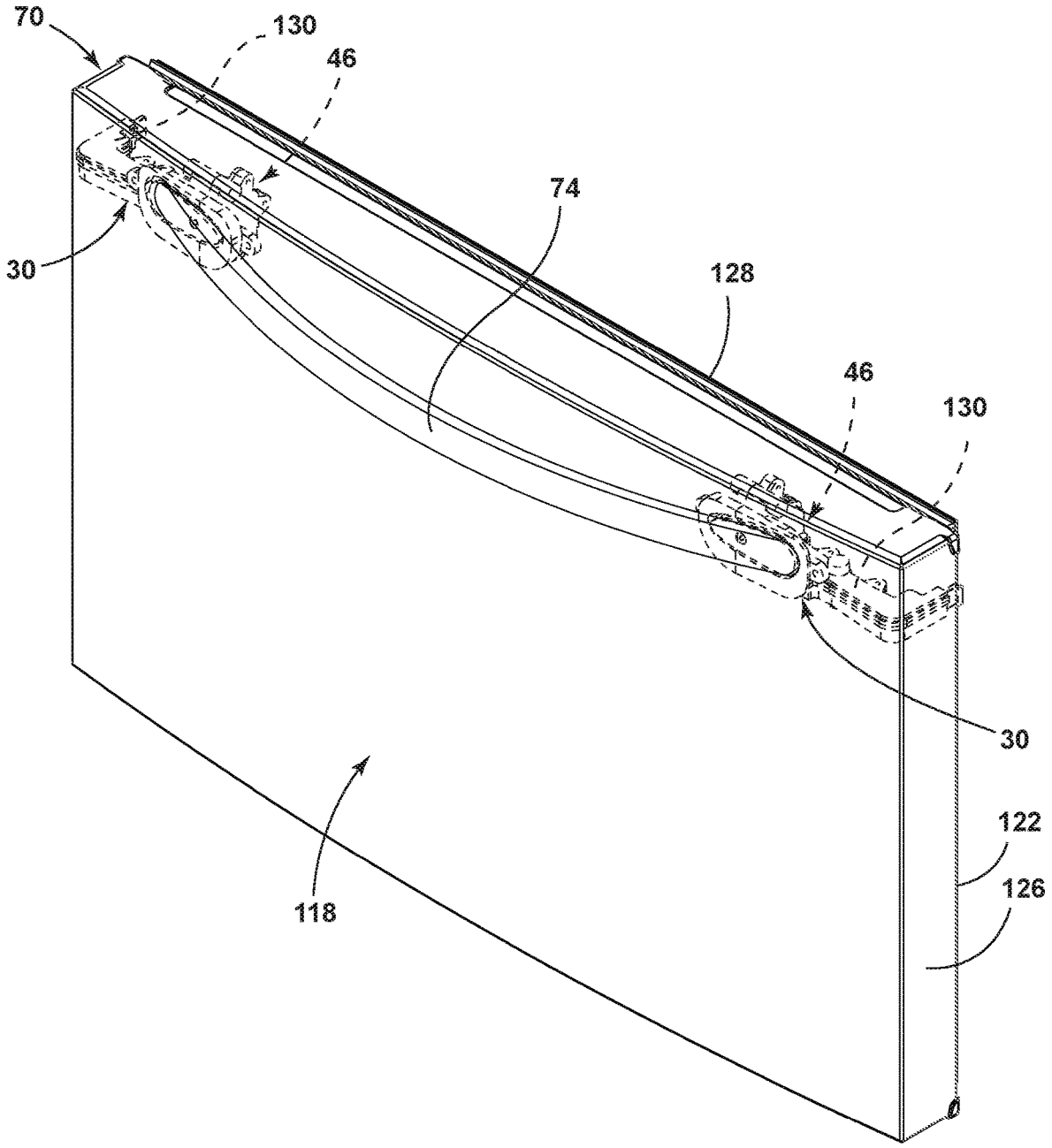
FIG. 5 is a front perspective view of a protruding handle with a Z lever mechanism having a straight extending pusher arm.
Figure 6:
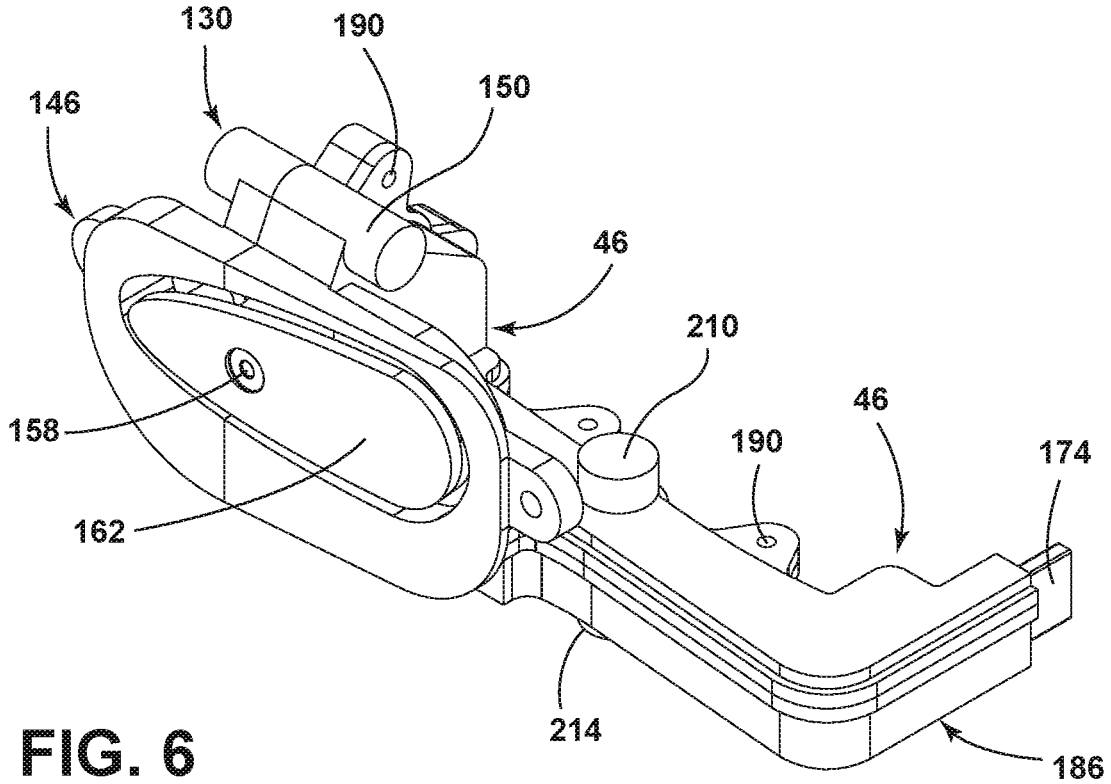
FIG. 6 is a front perspective view of an isolated Z lever mechanism with a retracted straight extending pusher arm.
Figure 7:
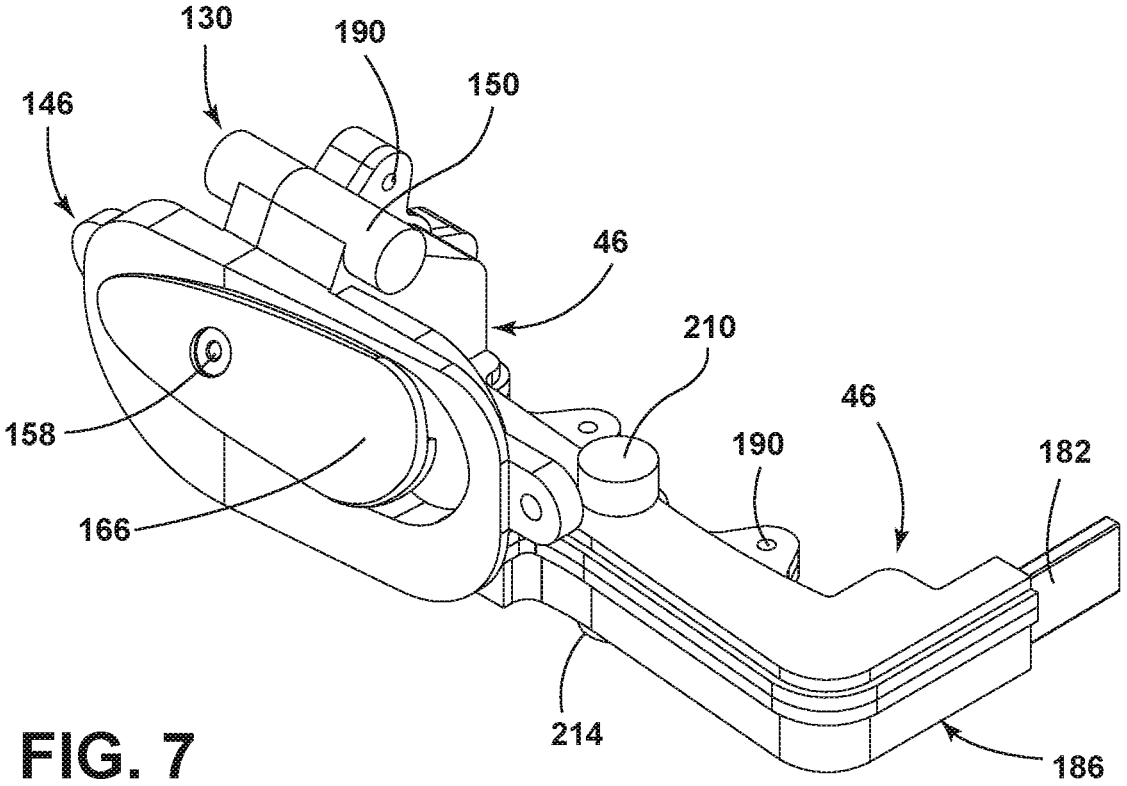
FIG. 7 is a front perspective view of an isolated Z lever mechanism with an extended straight extending pusher arm.
Figure 8:
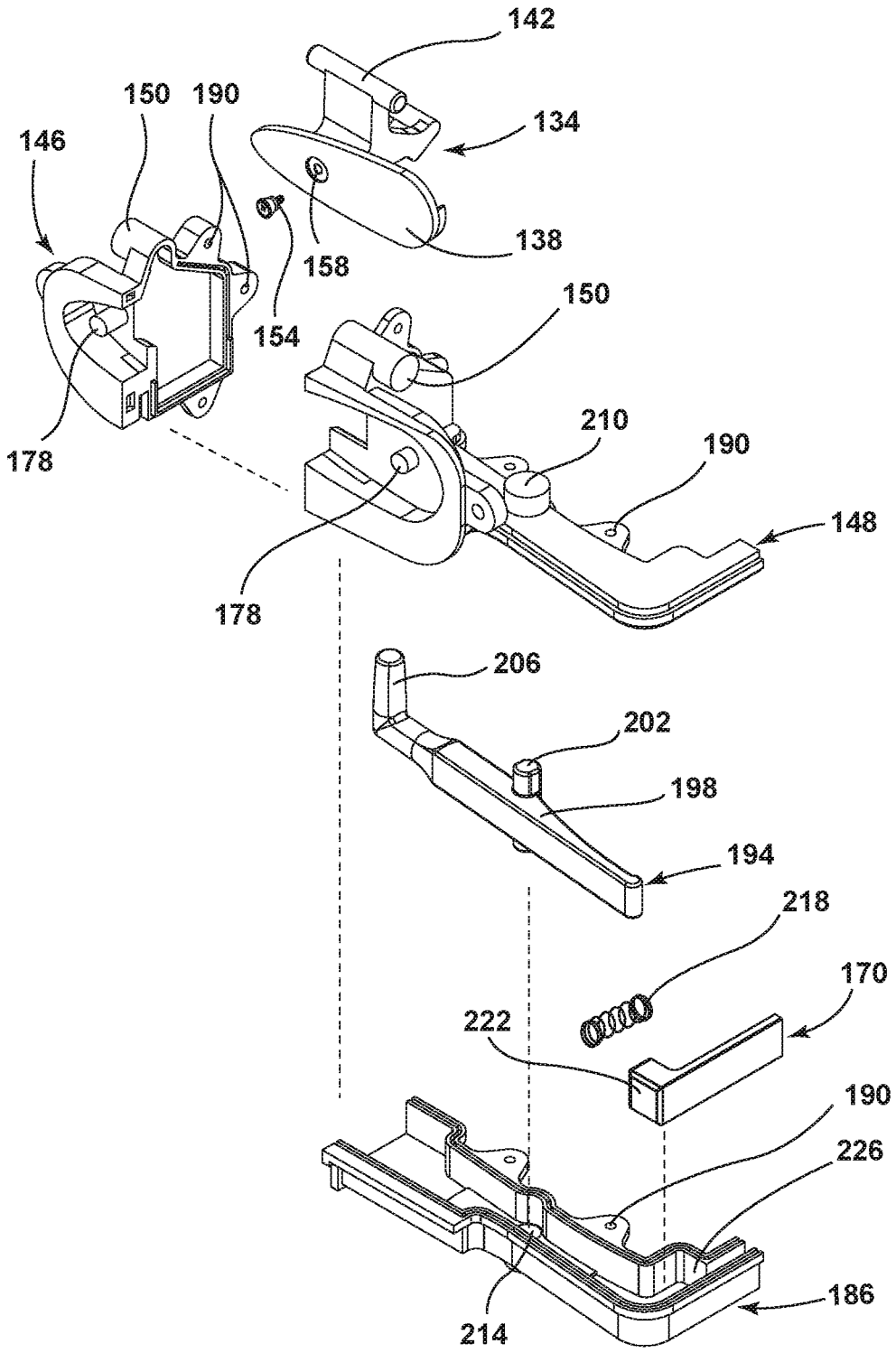
FIG. 8 is an exploded view of a Z lever mechanism having a straight extending pusher arm.

Referring now to FIGS. 2-4, the refrigerator door 66 may have various embodiments of the pocket handle 78. In FIG. 2, the pocket handle 78 has a pocket bottom grip 82 having a top pivot point 86. A user would reach their hand into a pocket receiving area 90 enclosed by a pocket wall 94 to pull on the pocket bottom grip 82 and rotate it towards a handle backstop 98. The pocket bottom grip 82 having the top pivot point 86 would have a top actuation mechanism for engaging the opening actuator 30 (FIG. 5). In FIG. 3, the pocket handle 78 has a pocket handle grip 102 with a center mount 106 coupled to a channel 104. The user would pull the pocket handle grip 102 in a linear direction towards the handle backstop 98 with the center mount 106 sliding along and positioned in the channel 104. The pocket handle grip 102 does not rotate and would have a linear actuation mechanism for engaging the opening actuator 30. In FIG. 4, the pocket handle 78 has a pocket handle top grip 110 with a bottom pivot point 114. The user can rotate the pocket handle top grip 110 counterclockwise around the bottom pivot point 114 to engage the opening actuator 30. The pocket handle top grip 110 having the bottom pivot point 114 would have a bottom actuation mechanism for engaging the opening actuator 30.

In some embodiments, the two examples of door handles 26 used with the opening actuator 30 are the protruding handle 74 and the pocket handle 78. These types of handle 74 can be made from any suitable material for a desired feel, weight, and look for the user. The protruding handle 74 may be made into any shape or length and can be connected to an outside surface of the door 22 in any position. In some non-limiting embodiments, the protruding handle 74 is coupled in a vertical position along an edge of the door while in other embodiments the protruding handle 74 is coupled in a horizontal position along a top or bottom edge of the door. In other embodiments, the protruding handle 74 can be placed near the center of the door. Regardless of the construction or location of the door handle 26, the door handle 26 is connected to the opening actuator 30 to transfer movement from the door handle 26 to pusher arm 50. This connection between the door handle 26 and the opening actuator 30 can be made at a single point with one discrete opening actuator 30 to transfer movement from the door handle 26 to the pusher arm 50. The door handle 26 may also be coupled to two opening actuators 30, for example, at each end of the protruding handle 74 on the door 22 or drawer. One or more opening actuators 30 can be coupled to the protruding handle 74 in a variety of different locations. In some embodiments, the protruding handle 74 is coupled to two opening actuators 30 and in other embodiments the protruding handle 74 is connected to just one opening actuator 30.

Referring now to FIG. 5, the freezer door 70 is constructed from a door wrapper 118 and a door liner 122 having a side trim 126 coupling the wrapper 118 and liner 122. In some embodiments, the side trim 126 may be comprised of the door wrapper 118 extending around from the outside surface of the freezer door 70 to couple the door liner 122. The freezer door 70 additionally has the protruding handle 74 coupled to the opening actuator 30 where the actuator mechanism 46 is a Z lever mechanism 130. The Z lever mechanism 130 has a straight extending pusher arm 170 (FIG. 8) that extends out against the front wrapper side 54 (FIG. 20) of the refrigerator body 14 (FIG. 1) to break the seal of the gasket 128 around the edge of the freezer door 70 in contact with the front wrapper side 54 of the refrigerator body 14.

Referring now to FIGS. 5-8, the Z lever mechanism 130 includes a pivot handle plate 134 having a handle plate 138 and a pivot handle shaft 142. The pivot handle plate 134 is positioned inside a pivot handle mount 146 and an upper casing 148 with the pivot handle shaft 142 positioned inside a pivot shaft receiving member 150. The pivot handle plate 134 is coupled to the protruding handle 74 through a screw lug 154 and a screw lug receiving member 158 where the pivot handle plate 134 can have the handle plate 138 in a retracted position 162 or an extended position 166. When the handle plate 138 is in the retracted position 162, the straight extending pusher arm 170 is also in a retracted pusher arm position 174. In the retracted pusher arm position 174 the pivot handle plate 134 rests or is positioned against one or more spacing members 178. When the handle plate 138 is in the extended position 166, the straight extending pusher arm 170 is also in an extended pusher arm position 182. A lower casing 186 is coupled to the upper casing 148 through a plurality of coupling members 190 to enclose a lever 194. The lever 194 is made up of a lever body 198, a fulcrum member 202, and a handle pivot arm 206 for transferring motion imparted by the pivot handle plate 134. The lever 194 is coupled to the straight extending pusher arm 170. The fulcrum member 202 of the lever 194 is positioned in an upper 210 and a lower 214 fulcrum receiving member formed in the upper and lower casing 148, 186, respectively. A spring 218 is additionally enclosed by the upper and lower casings 148, 186 where the spring 218 is positioned and partially compressed between a plunger spring wall 222 and a spring housing wall 226. The spring 218 strength or spring 218 constant can be tuned to enhance the user's sensorial experience through touch. An adjustment of the spring 218 can be used to modify the resistance or retraction of the door handle 26 or for a better sensorial experience for the user interfacing with the door handle 26.

Figure 9:
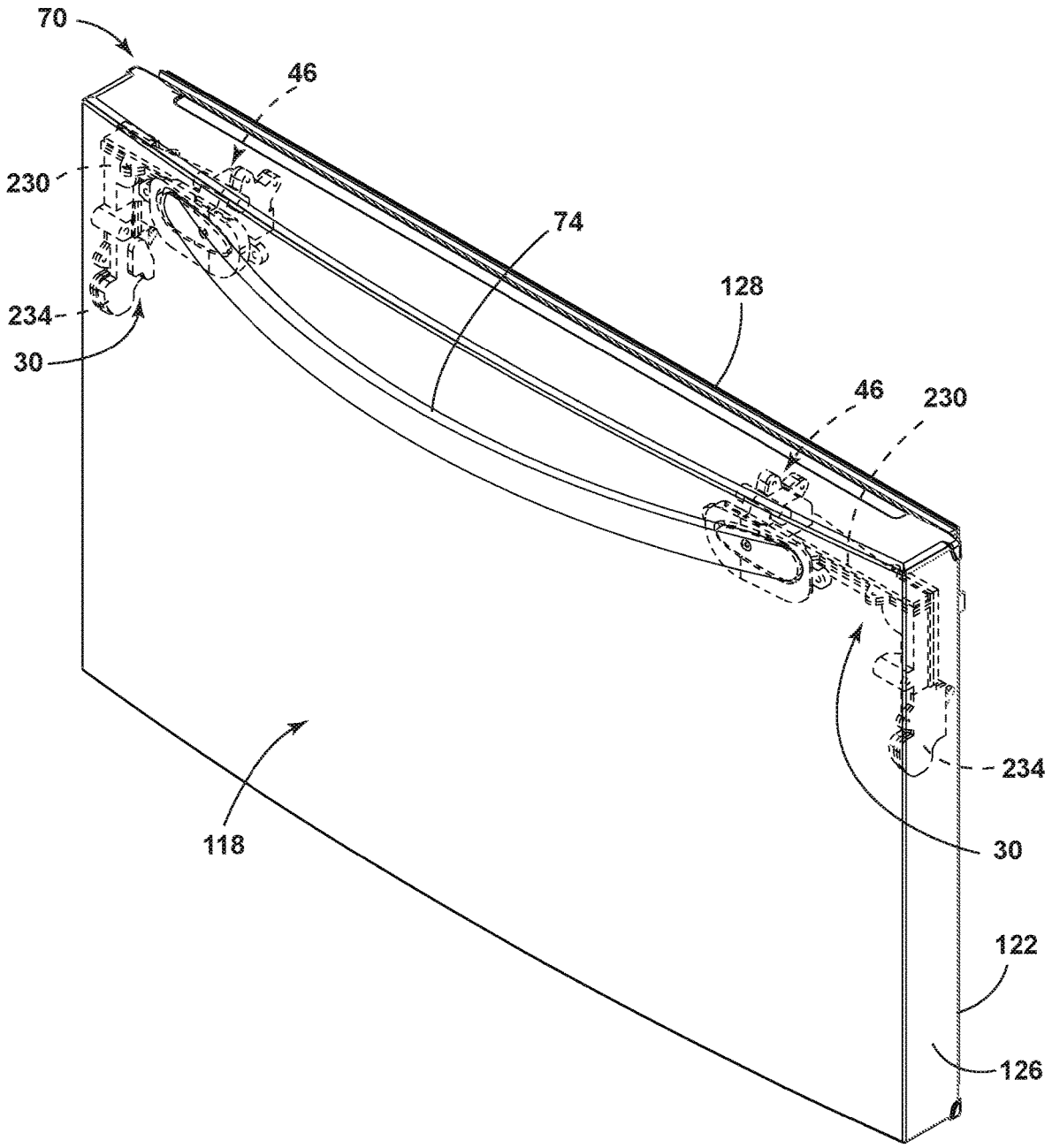
FIG. 9 is a front perspective view of a protruding handle having a pulley mechanism for a rotating pusher arm.
Figure 10:
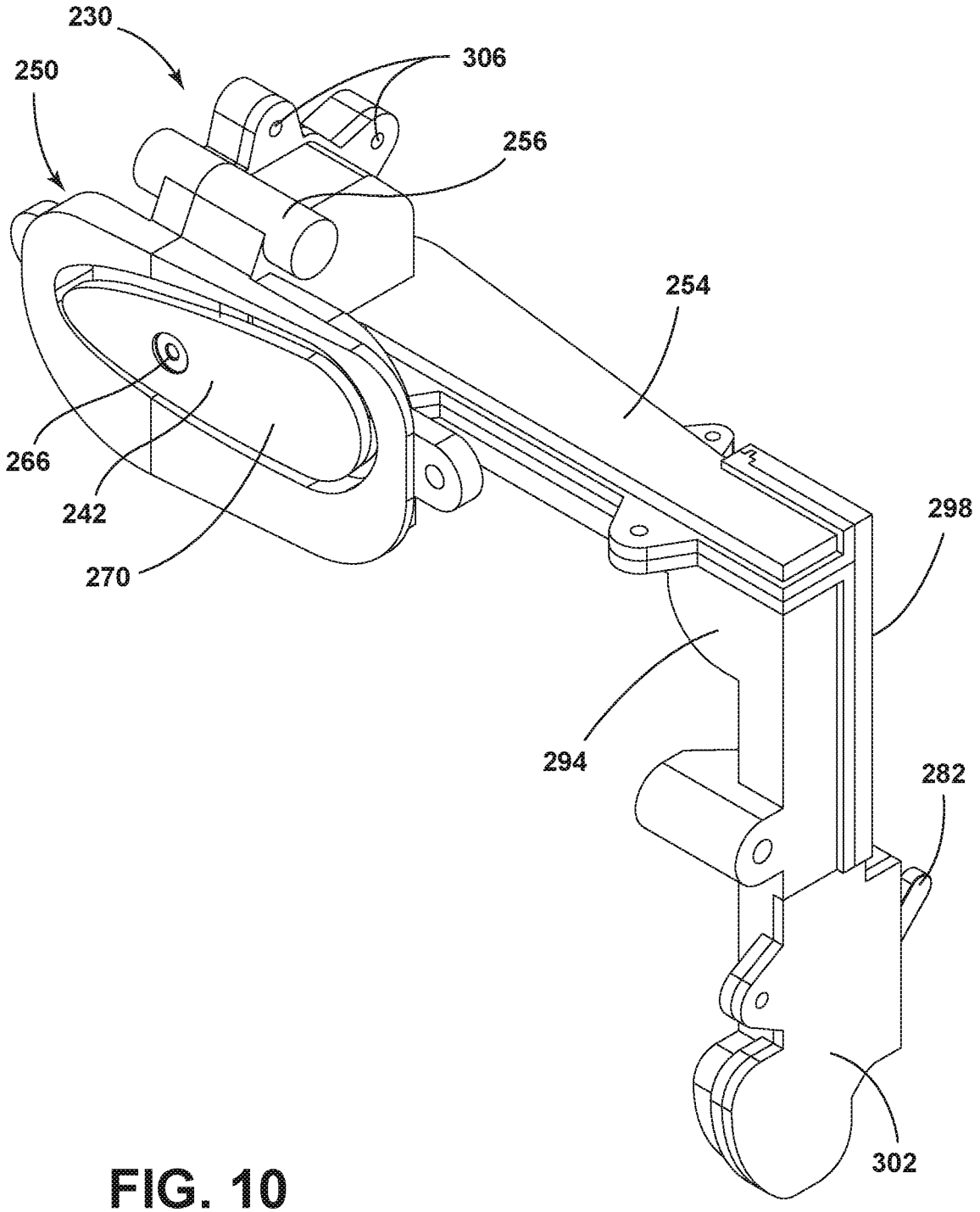
FIG. 10 is a front perspective of an actuator mechanism using a pulley mechanism with a retracted rotating pusher arm.
Figure 11:
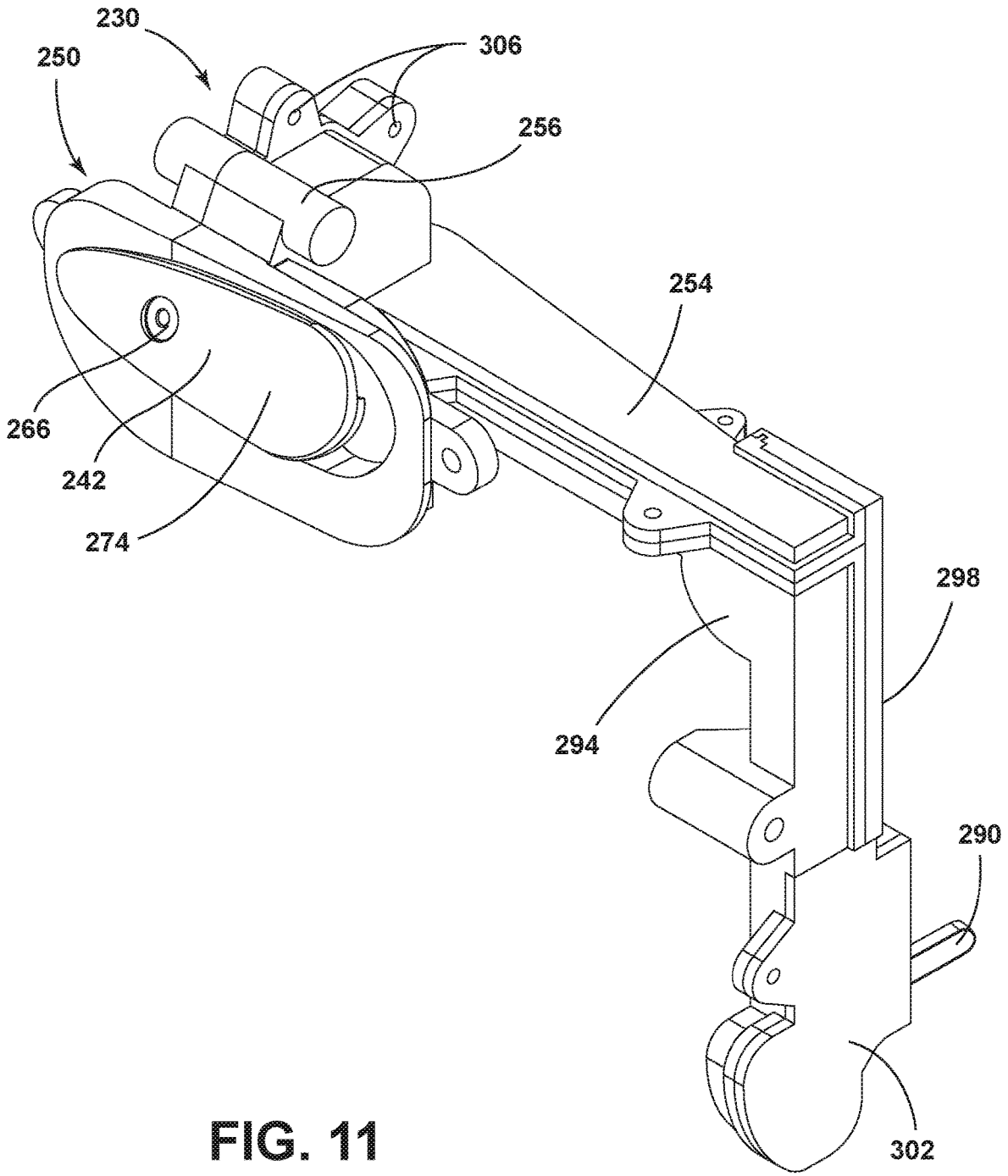
FIG. 11 is a front perspective view of the actuator mechanism using a pulley mechanism with an extended rotating pusher arm.
Figure 12:
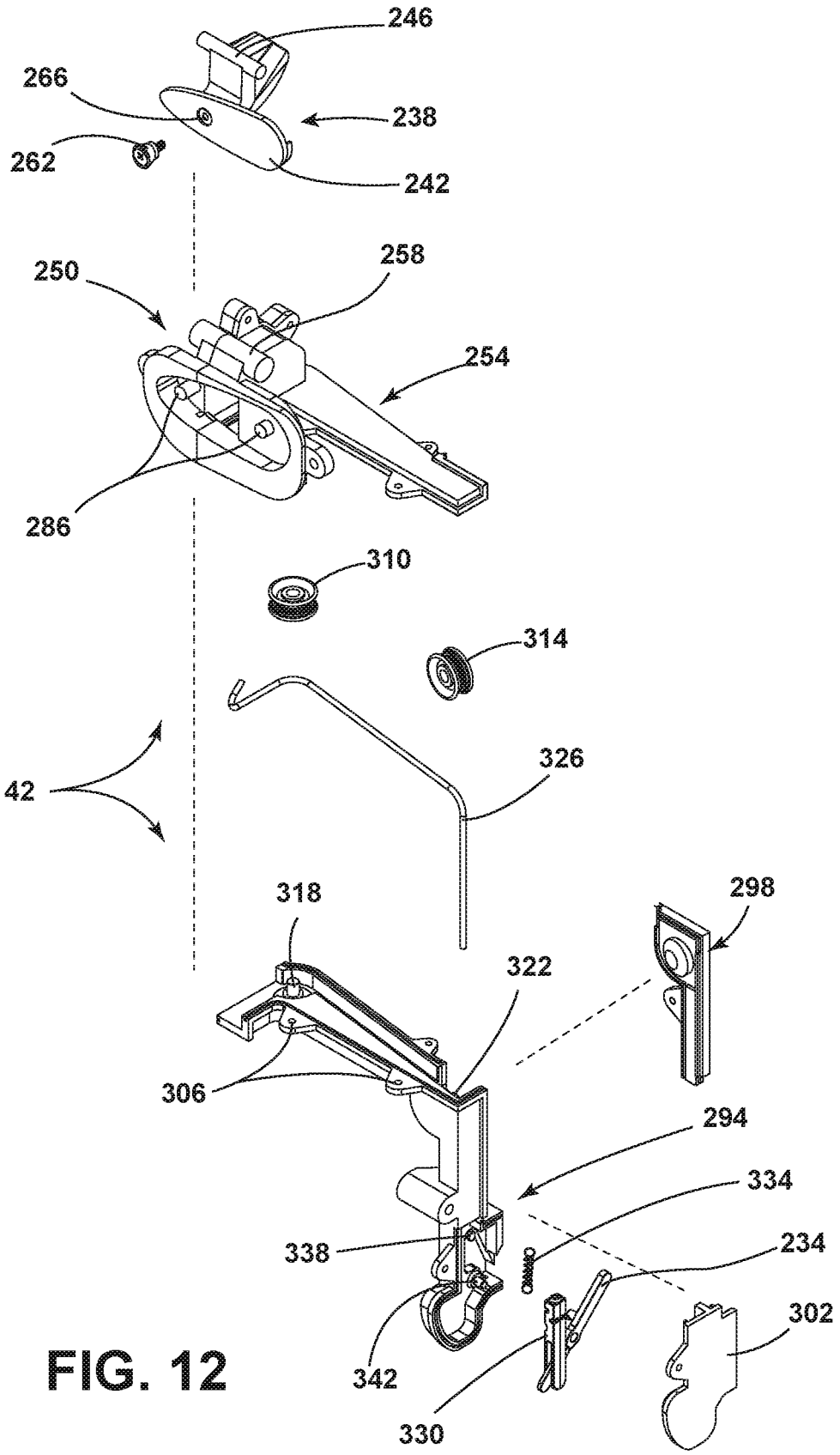
FIG. 12 is an exploded view of an actuator mechanism using a pulley mechanism with a rotating pusher arm.

Referring now to FIG. 9, the freezer door 70 is constructed from the door wrapper 118 and the door liner 122 with the side trim 126 connecting the wrapper 118 and liner 122. The freezer door 70 additionally has the protruding handle 74 coupled to the opening actuator 30. The opening actuator 30 has the actuation mechanism 46 which includes a pulley mechanism 230 with a rotating pusher arm 234. The pulley mechanism 230 initiates the rotating pusher arm 234 to rotate and push against the front wrapper side 54 (FIG. 20) of the refrigerator body 14 (FIG. 1) to break the seal of the gasket 128 around the edge of the freezer door 70 in contact with the front wrapper side 54 of the refrigerator body 14.

Referring now to FIGS. 9-12, the pulley mechanism 230 includes a pivot handle plate 238 having a handle plate 242 and a pivot handle shaft 246. The pivot handle plate 238 is positioned inside a pivot handle mount 250 and an upper casing 254 with the pivot handle shaft 246 positioned inside a pivot shaft receiving member 256. The pivot handle plate 238 is coupled to the protruding handle 74 through a screw lug 262 and a screw lug receiving member 266. The pivot handle plate 238 can have the handle plate 242 in a retracted handle plate position 270 or in an extended handle plate position 274. In the retracted handle plate position 270, the rotating pusher arm 234 is in a retracted position 282 or is rotated out of the way, and the pivot handle plate 238 rests or is positioned on one or more spacing members 286. If the handle plate 242 is in the extended handle plate position 274, the rotating pusher arm 234 is in an extended plunger position 290 or is rotated out in contact with the front wrapper side 54 (FIG. 20) of the refrigerator body 14 (FIG. 1). A bottom casing member 294 is coupled to a pulley casing cover 298 and a plunger casing cover 302 through a plurality of coupling members 306. The casing 42 made by these casing pieces 294, 298, 302 contains a first pulley 310 and a second pulley 314 mounted on a first pulley boss 318 and a second pulley boss 322 with a flexible cable 326 positioned around the two pulleys 310, 314 and coupled to the pivot handle plate 238 and a plunger actuator 330. An extension spring 334 is positioned on a top and bottom spring mount 338, 342 to apply tension to the plunger actuator 330 which controls the articulating or rotating pusher arm 234. The extension spring 334 strength or extension spring 334 constant can be tuned to enhance the user's sensorial experience through touch. An adjustment of the extension spring 334 can be used to modify the resistance or retraction of the door handle 26 or for a better sensorial experience for the user interfacing with the door handle 26 (FIG. 1).

Figure 13:
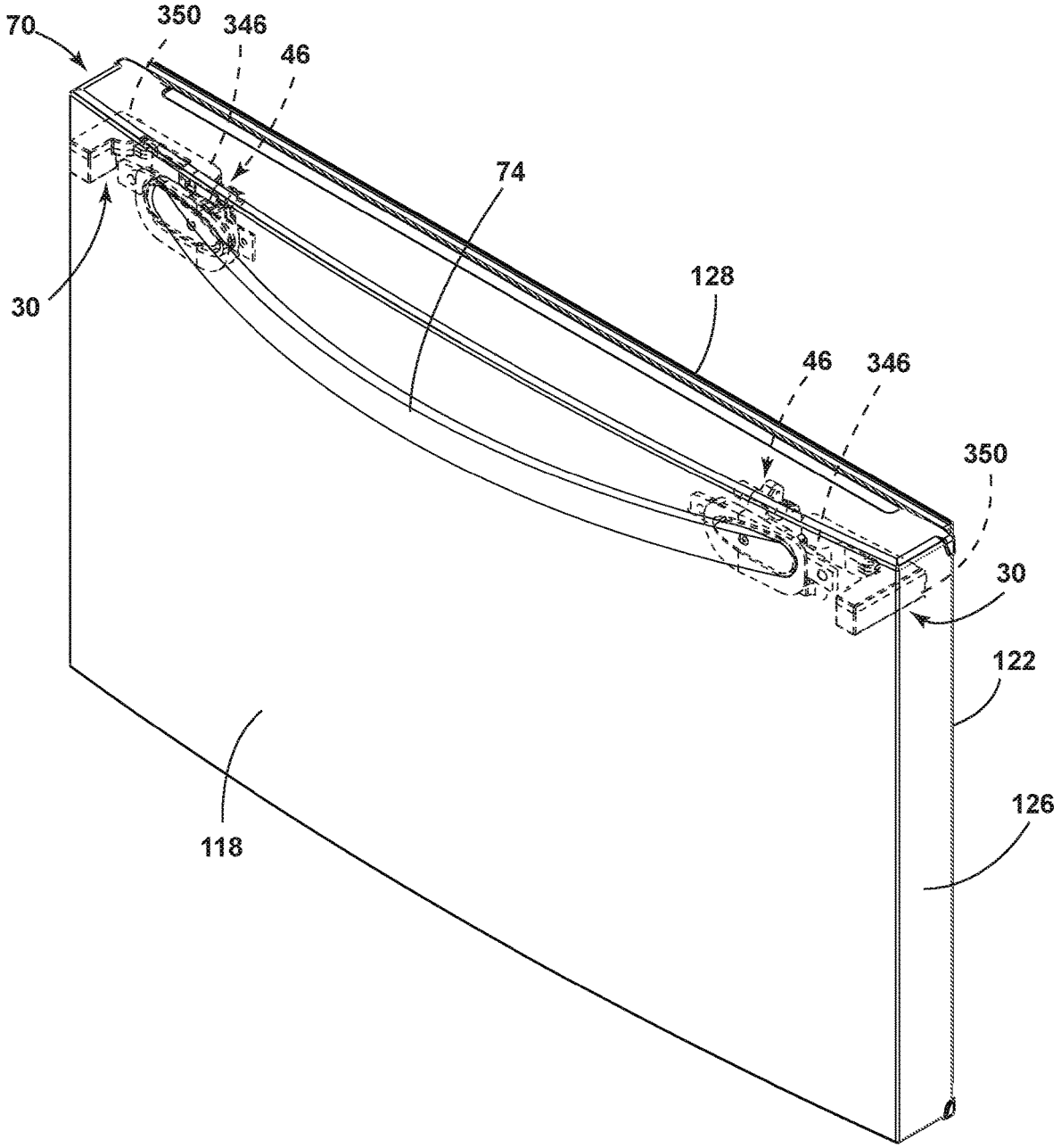
FIG. 13 is a front perspective view of a protruding handle coupled to an actuator mechanism using a pulley mechanism having straight extending pusher arms.
Figure 14:
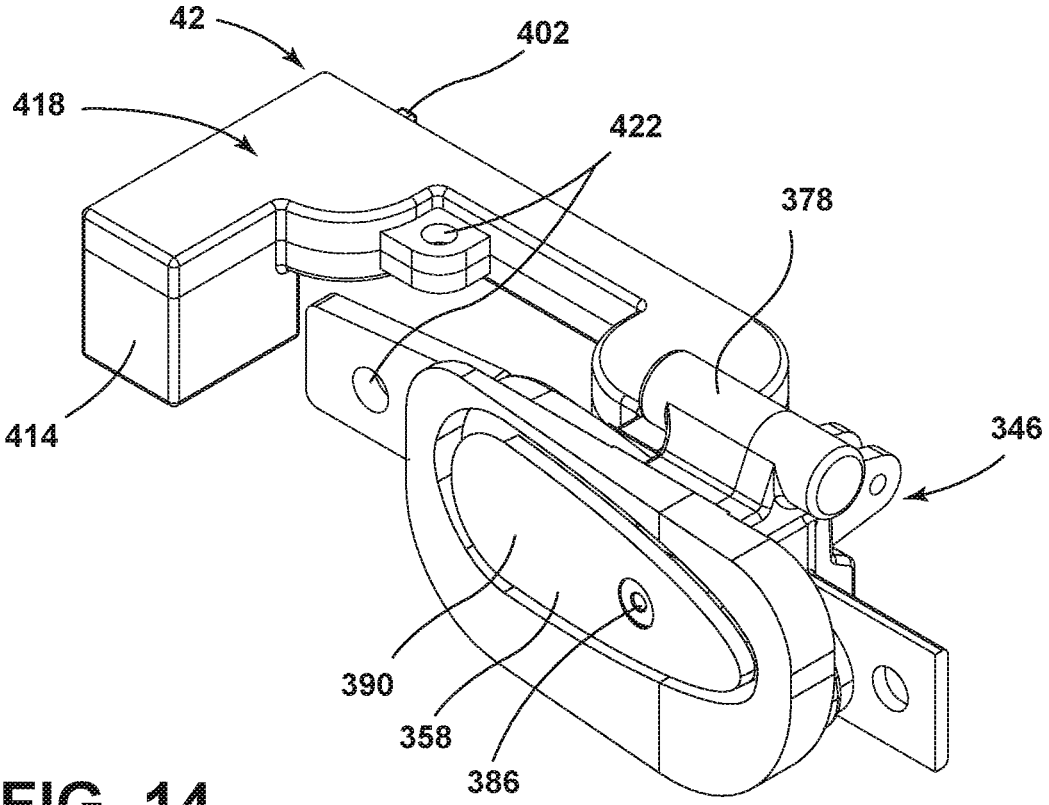
FIG. 14 is a front perspective view of a pulley mechanism having a retracted straight extending pusher arm.
Figure 15:
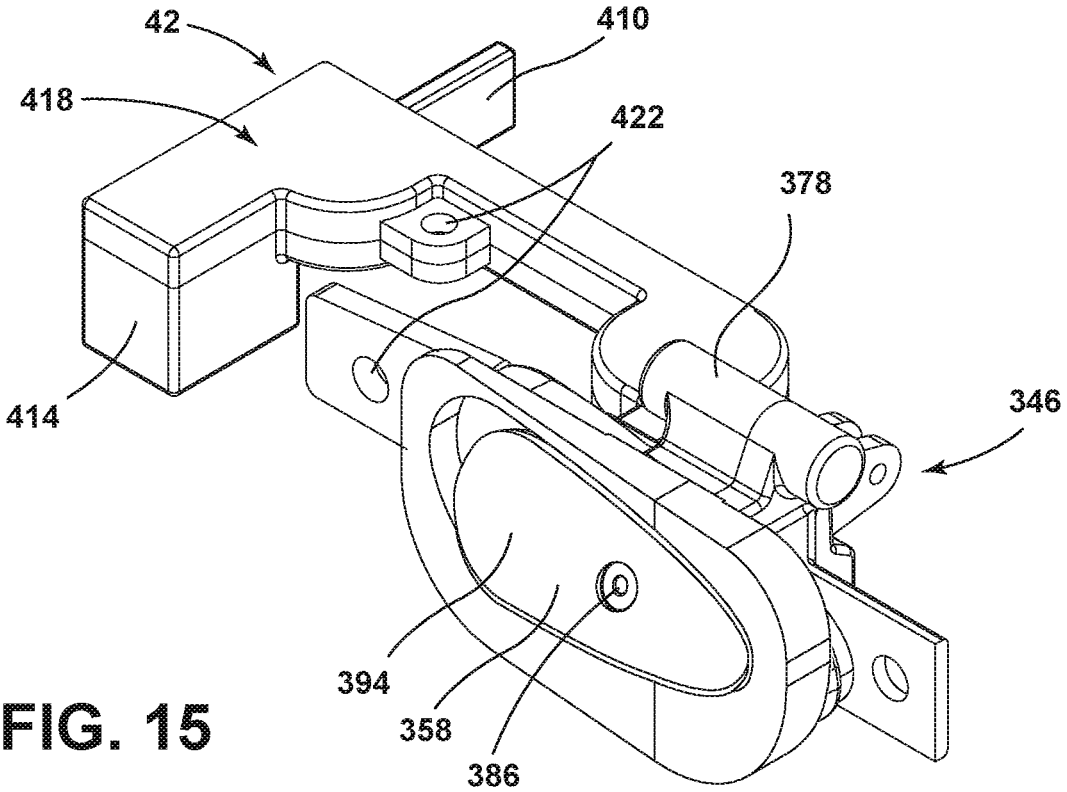
FIG. 15 is a front perspective view of an actuator mechanism using a pulley mechanism with an extended straight extending pusher arm.
Figure 16:
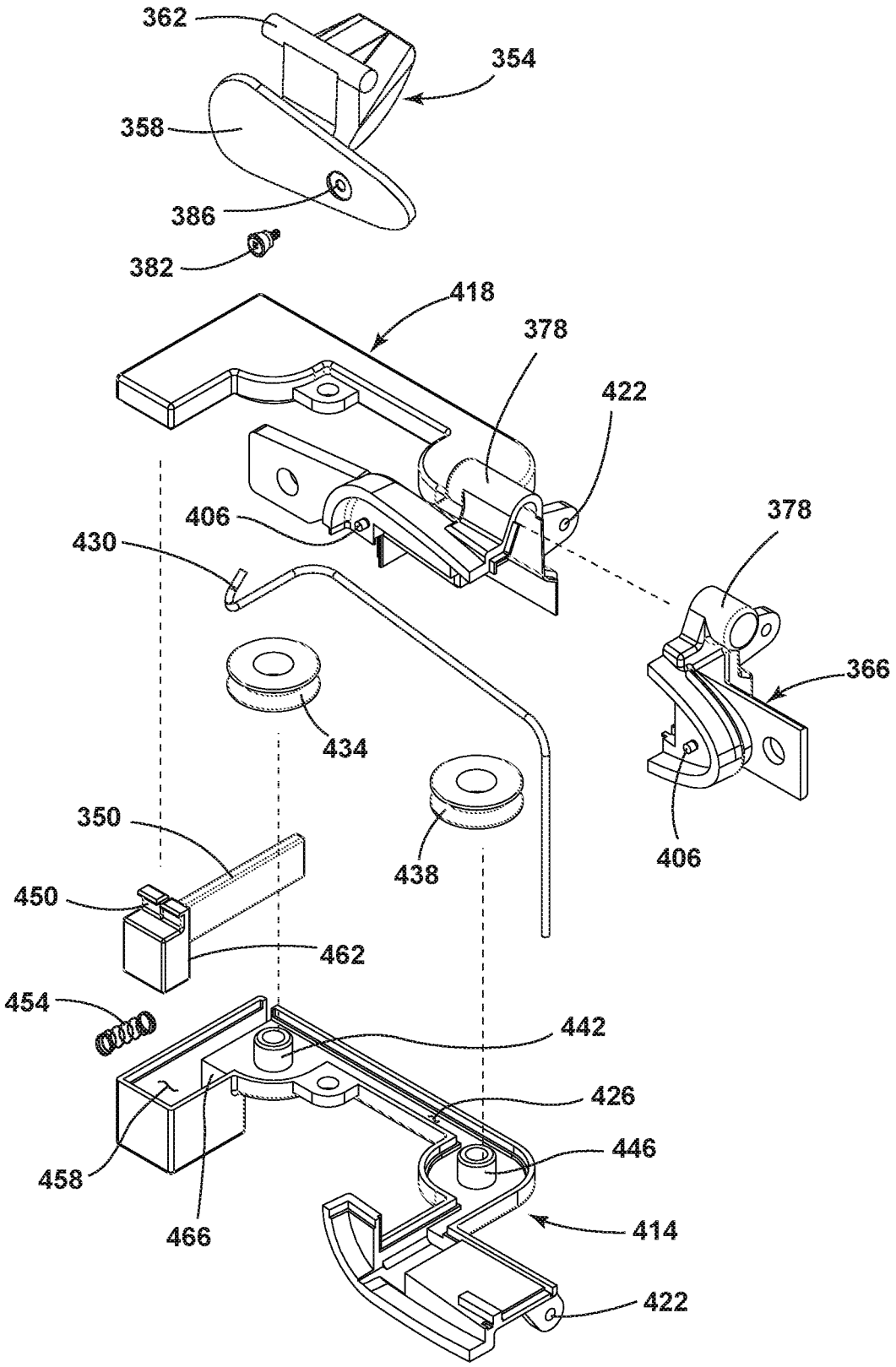
FIG. 16 is an exploded view of the pulley mechanism having a straight extending pusher arm.

Referring now to FIG. 13, the freezer door 70 is constructed from the door wrapper 118 and the door liner 122 with the door side trim 126 connecting the wrapper 118 and liner 122. The freezer door 70 additionally has the protruding handle 74 coupled to the opening actuator 30. The opening actuator 30 has the actuator mechanism 46 which includes a pulley mechanism 346 and a straight extending pusher arm 350. The pulley mechanism 346 extends the straight extending pusher arm 350 to push directly outwards against the front wrapper side 54 (FIG. 20) of the refrigerator body 14 (FIG. 1) to break the seal of the gasket 128 around the edge of the freezer door 70 in contact with the front wrapper side 54 of the refrigerator body 14.

As shown in FIGS. 13-16, the pulley mechanism 346 has a pivot handle plate 354 with a handle plate 358 and a pivot handle shaft 362. The pivot handle plate 354 is positioned inside a pivot handle mount 366 and an upper casing member 418 with the pivot handle shaft 362 positioned inside a pivot shaft receiving member 378. The pivot handle plate 354 is coupled to the protruding handle 74 through a screw lug 382 and a screw lug receiving member 386. The pivot handle plate 354 can have the handle plate 358 in a retracted position 390 or in an extended handle plate position 394. In the retracted handle plate position 390, a straight extending pusher arm 350 is in a retracted plunger position 402 and the pivot handle plate 354 rests or is positioned on one or more spacing members 406. In the extended handle plate position 394, the straight extending pusher arm 350 is in an extended plunger position 410 to be in contact with the front wrapper side 54 (FIG. 20) of the refrigerator body 14 (FIG. 1). A bottom casing member 414 couples the upper casing member 418 through a plurality of coupling members 422. The casing 42 made by these casing pieces 414, 418 contains a flexible cable receiving area 426 for a flexible cable 430, the straight extending pusher arm 350, a first pulley 434, and a second pulley 438. The first and second pulleys 434, 438 are mounted on a first pulley boss 442 and a second pulley boss 446, respectively, with the flexible cable 430 positioned around the first and second pulleys 434, 438 and coupled to the pivot handle plate 354 and a cable connecting member 450. A spring 454 is compressed and positioned in a spring receiving area 458 between a plunger spring wall 462 and a spring stopping wall 466. The spring 454 strength or spring 454 constant can be tuned to enhance the user's sensorial experience through touch. An adjustment of the spring 454 can be used to modify the resistance or retraction of the door handle 26 or for a better sensorial experience for the user interfacing with the door handle 26 (FIG. 1).

Referring now to FIG. 17, the freezer door 70 is made from the door wrapper 118 and the door liner 122 which are coupled through the door side trim 126 connecting the wrapper 118 and liner 122. The freezer door 70 additionally includes the protruding handle 74 coupled to the opening actuator 30. The opening actuator 30 has the actuator mechanism 46 which includes a sheathed cable mechanism 470 and a straight extending pusher arm 474 where the straight extending pusher arm 474 pushes directly outwards against the front wrapper side 54 (FIG. 20) of the refrigerator body 14 (FIG. 1) to break the seal of the gasket 128 around the edge of the freezer door 70 in contact with the front wrapper side 54 of the refrigerator body 14.

Referring now to FIGS. 17-19, the sheathed cable mechanism 470 has a pivot handle plate 478 with a handle plate 482 and a pivot handle shaft (not shown) positioned in a pivot shaft receiving member 490. The pivot handle plate 478 is coupled to the protruding handle 74 through a screw lug 494 and a screw lug receiving member 498 while the pivot handle plate 478 can have the handle plate 482 in a retracted handle plate position 502 or an extended handle plate position 506. In the retracted handle plate position 502 a straight extending pusher arm 474 is in a retracted plunger position 512 and the pivot handle plate 478 rests or is positioned on one or more spacing members (not shown). In the extended handle plate position 506, the straight extending pusher arm 474 is an extended plunger position 514. The pivot handle plate 478 is positioned in an upper casing 518 with a top cable fastener 520 that is coupled together through a plurality of coupling members 522 while a bottom cable fastener 524 and the straight extending pusher arm 474 are positioned in a lower plunger casing member 526. The straight extending pusher arm 474 is positioned in the lower plunger casing 526 having a plunger casing cover 528. A sheathed cable 530 has a flexible cable 534 positioned inside a flexible sheath 538 where the flexible sheath 538 may be made from a thermoplastic or thermoset polymer.

The disclosure herein encompasses any combination using the options discussed herein regarding the door handle 26, actuator mechanism 46, and type of pusher arm 50 movement. For example, in some embodiments, the protruding handle 74 may be used with the Z lever mechanism 130 and the straight extending pusher arm 170 (see FIGS. 5-8). In other embodiments, the protruding handle 74 may be used with the Z level mechanism 130 and the rotating pusher arm 234. In other embodiments, the protruding handle 74 may be used with the pulley mechanism 230 and the rotating pusher arm 234 (see FIGS. 9-12). In other embodiments, the protruding handle 74 may be used with the pulley mechanism 346 and the straight extending pusher arm 350 (see FIGS. 13-16). In still other embodiments, the protruding handle 74 may be used with the sheathed cable mechanism 470 and the rotating pusher arm 234. In yet other embodiments, the protruding handle 74 may be used with the sheathed cable mechanism 470 and the straight extending pusher arm 474 (see FIGS. 17-19)

In some embodiments, the pocket handle 78 (top actuation, linear actuation, or bottom actuation) may be used with the Z lever mechanism 130 and the straight extending pusher arm 170. In other embodiments, the pocket handle 78 (top actuation, linear actuation, or bottom actuation) may be used with the Z lever mechanism 130 and the rotating pusher arm 234. In other embodiments, the pocket handle 78 (top actuation, linear actuation, or bottom actuation) may be used with the pulley mechanism 230 and the rotating pusher arm 234. In other embodiments, the pocket handle 78 (top actuation, linear actuation, or bottom actuation) may be used with the pulley mechanism 230 and the straight extending pusher arm 170. In other embodiments, the pocket handle 78 (top actuation, linear actuation, or bottom actuation) may be used with the sheathed cable mechanism 470 and the rotating pusher arm 234. In other embodiments, the pocket handle 78 (top actuation, linear actuation, or bottom actuation) may be used with the sheathed cable mechanism 470 and the straight extending pusher arm 474.

Figure 20:
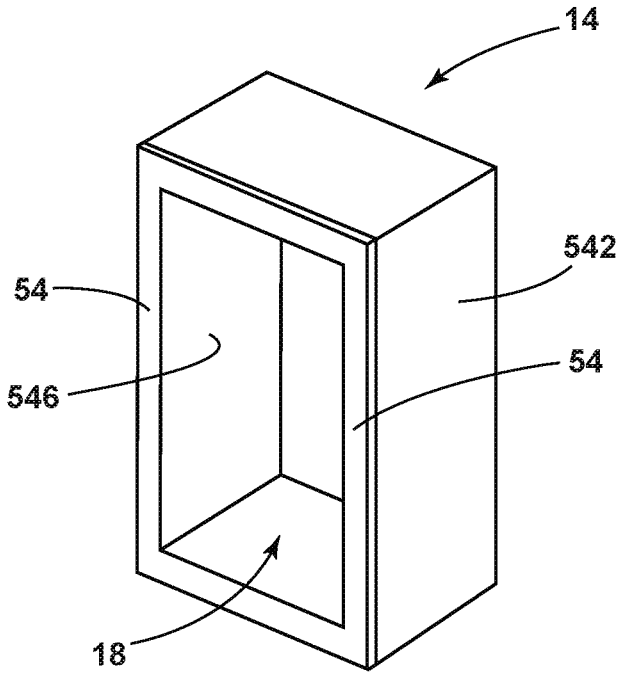
FIG. 20 is a perspective view of a refrigerator body according to one aspect of the present disclosure.

Referring now to FIG. 20, the refrigerator body 14 includes a body wrapper 542, a body liner 546, and the front wrapper edge 54. The front wrapper side 54 extends around the perimeter of the interior storage space 18 of the refrigerator body 14. The front wrapper edge 54 may not include any edges or surfaces formed by a mullion separating one or more interior storage spaces 18.

Figure 21A:
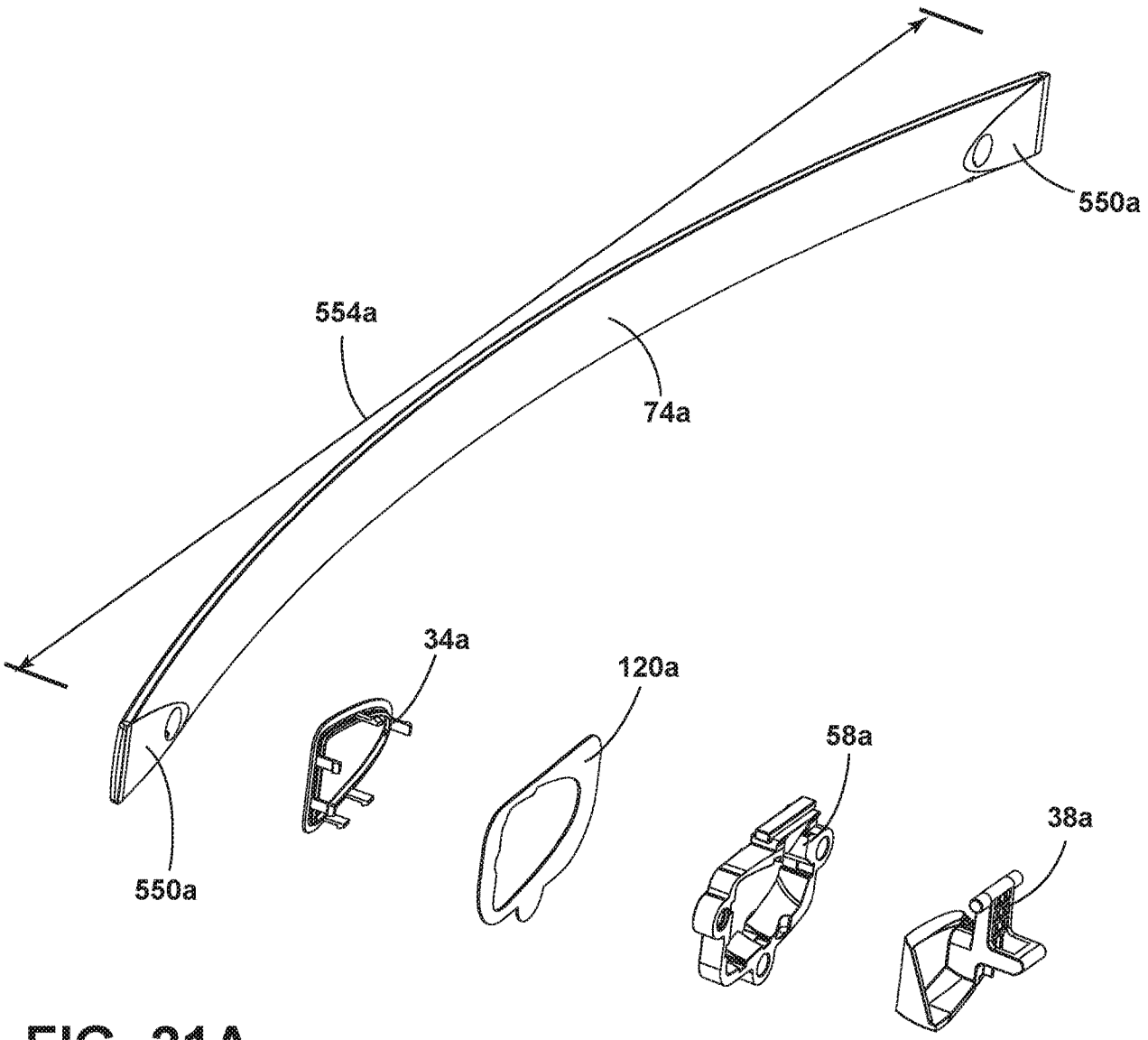
FIGS. 21A-21C are exploded views of various protruding handles and their coupling to an opening actuator.
Figure 21B:
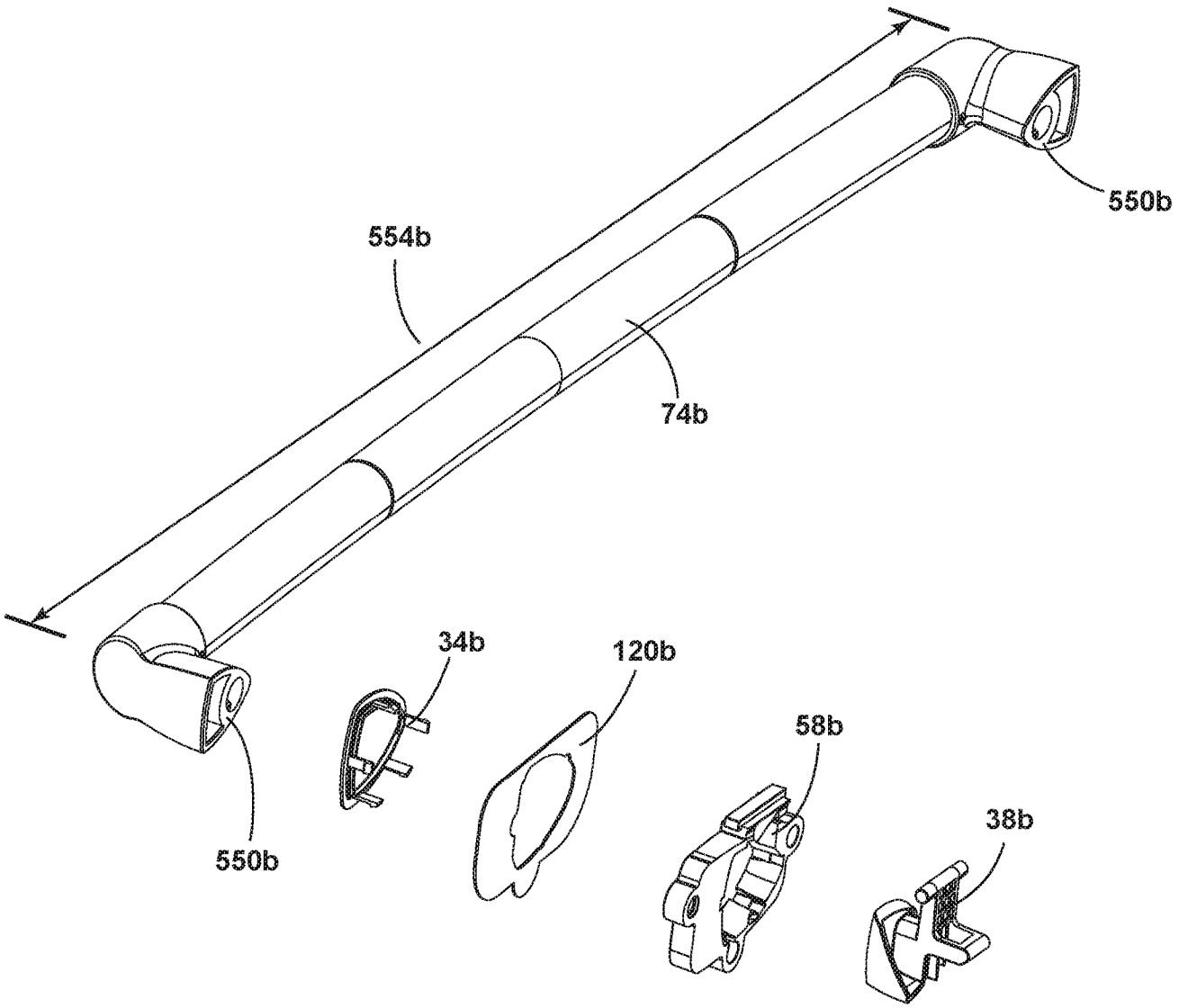
Figure 21C:
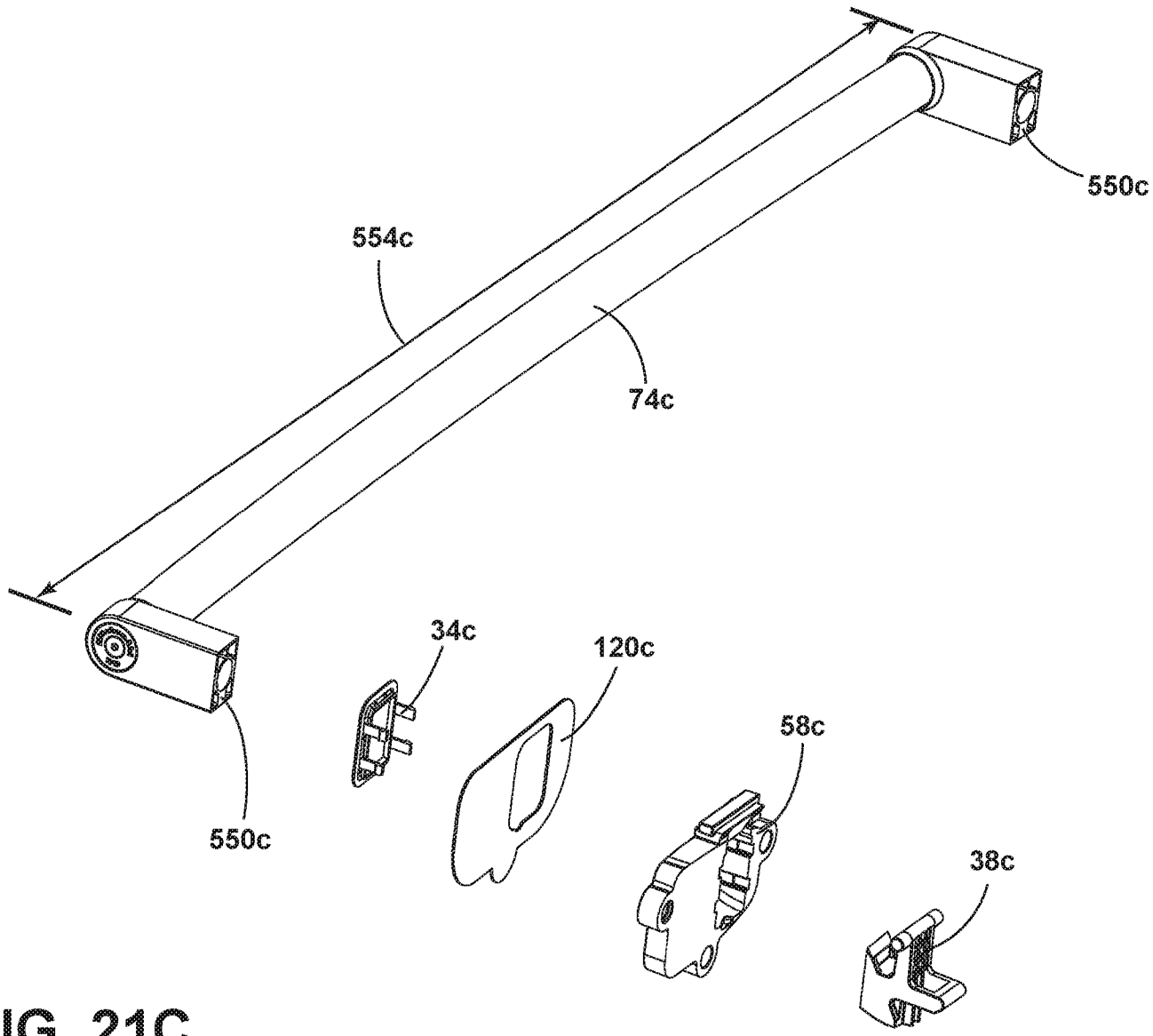

Referring now to FIGS. 21A-21C, a modular approach and mounting method is provided to couple the protruding handle 74 having a variety of different lengths and connecting portions (74*a*-74*c*) to an actuator attachment portion 558 (FIG. 22) of the opening actuator 30 positioned in the door 22. As discussed above, the protruding handle 74 has a handle connecting portion 550 and a handle length 554 depending on the desired design and use of the protruding handle 74 on the door 22. In general, the handle connecting portion 550 is coupled to the front bezel 34, the door wrapper 118, the intermediate attachment 58, and the pivot handle plate 38. Depending on the handle connecting portion 550 and the handle length 554, a variety of different designs for the actuator attachment portion 558 of the opening actuator 30 may be required. For example, in FIG. 21A, a handle connecting portion 550*a* has a lengthened triangular shape that requires the same lengthened triangular shape in a front bezel 34*a*, a wrapper foam tape 120*a*, an intermediate attachment 58*a*, and a pivot handle plate 38*a*. In another embodiment shown in FIG. 21B, a protruding handle 74*b* may have a shortened triangular connecting portion 550*b* and a shortened handle length 554*b*. As a result, the actuator attachment portion 558 will require the same shortened triangular shape in a front bezel 34*b*, a wrapper foam tape 120*b*, an intermediate attachment 58*b*, and a pivot handle plate 38*b*. In yet another embodiment shown in FIG. 21C, a protruding handle 74*c* may have a shorter length handle length 554*c* and a rectangular handle connecting portion 550*c*. As a result, a front bezel 34*c*, a wrapper foam tape 120*c*, an intermediate attachment 58*c*, and a pivot handle plate 38*c*, must all have the rectangular shape to couple the opening actuator 30 to the protruding handle 74*c* at a given length.

Figure 22:
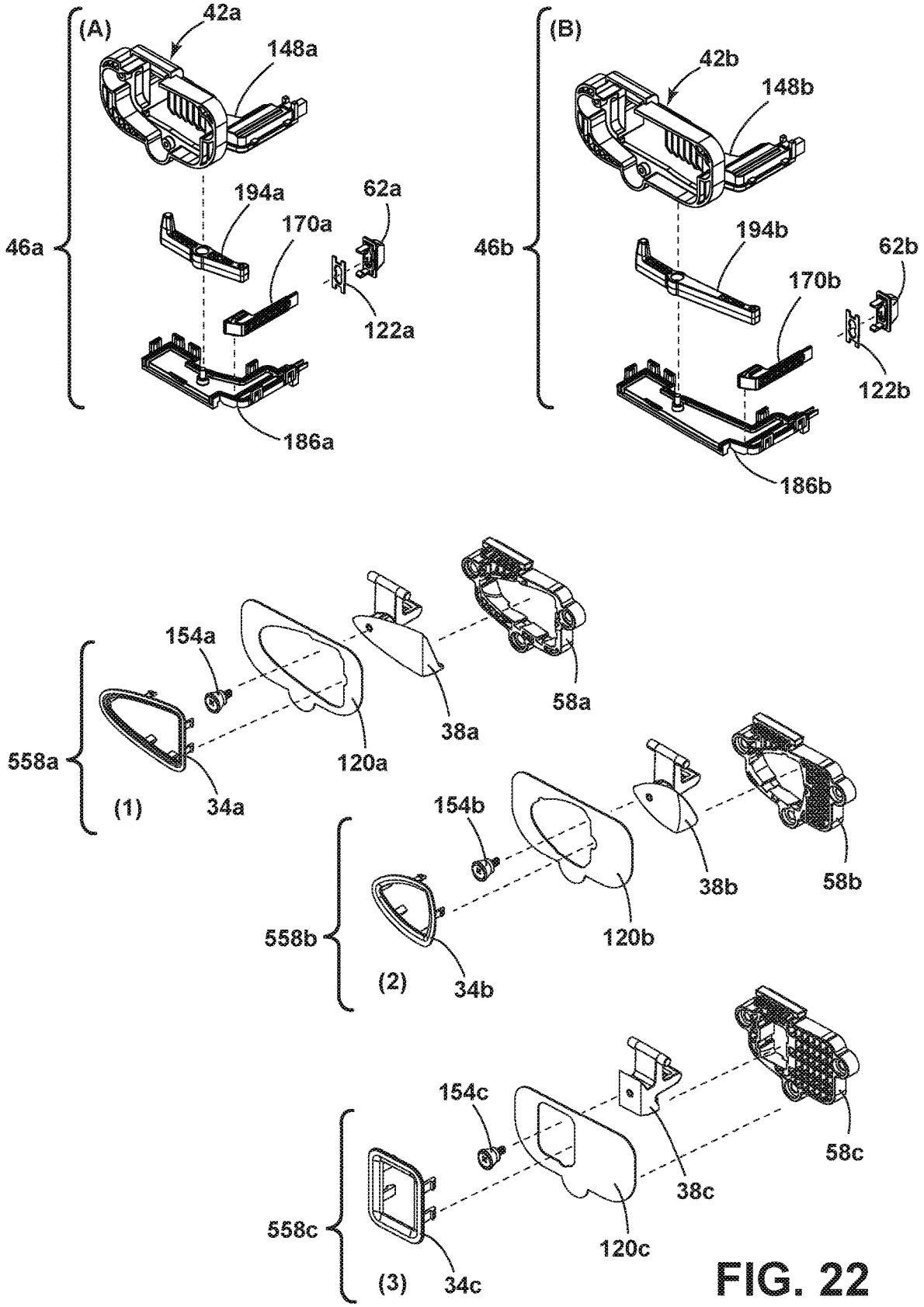
FIG. 22 is a modular approach to fitting a door handle to the appropriately fitted opening actuator according to one aspect of the present disclosure.

Referring now to FIG. 22, the modular approach and mounting method is exemplified according to one aspect of the current disclosure. In this modular approach, three different alternatives are shown for the actuator attachment portion 558 and two different alternatives are given for the actuator mechanism 46. For the actuator attachment portion 558, the three different options include a) a lengthened triangular attachment portion 558*a, b*) a shortened triangular attachment portion 558*b*, and c) a rectangular attachment portion 558*c*. Each of the actuator attachment portions 558 includes the front bezel 34*a*-34*c*, the screw lug 154*a*-154*c*, the wrapper foam tape 120*a*-120*c*, the pivot handle plate 38*a*-38*c*, and the intermediate attachment 58*a*-58*c*. The shape of the handle connecting portion 550 on the protruding handle 74 (FIGS. 21A-21C) will determine which of the three actuator attachment portions 558 will be used. In addition, the handle length 554 of the protruding handle 74 (FIGS. 21A-21C) will determine which of the two actuator mechanisms 46 will be used. Actuator mechanism 46*a* includes a shortened lever 194*a* and surrounding casing 42*a* while the actuator mechanism 46*b* has a longer lever 194*b* and casing 42*b* for the protruding handle 74 having a shorter length. In both options, the actuator mechanism 46*a*-46*b* includes a casing 42*a*-42*b*, a top casing 148*a*-148*b*, a lever 194*a*-194*b*, a pusher arm 170*a*-170*b*, a bottom casing 186*a*-186*b*, a liner foam tape 122*a*-122*b*, and a back bezel 62*a*-62*b*. The protruding handle 74 having a shorter length would likely be used with the longer actuator mechanism 46*b* while the protruding handle 74*b* with a longer length would likely be used with the actuator mechanism 46*a* having a shorter length. The wrapper and liner foam tape portions 120*a*-120*c* and 122*a*-122*b* are coupled to the inside of the door wrapper 118 and the door liner 122, respectively, to help prevent foam leaks. Using this modular approach to couple the opening actuator 30 to the protruding handle 74 gives designers and users the opportunity to custom build the refrigerator 10 with the desired functionality and aesthetics desired to easily open the door 22 with the opening actuator 30.

Figure 23:
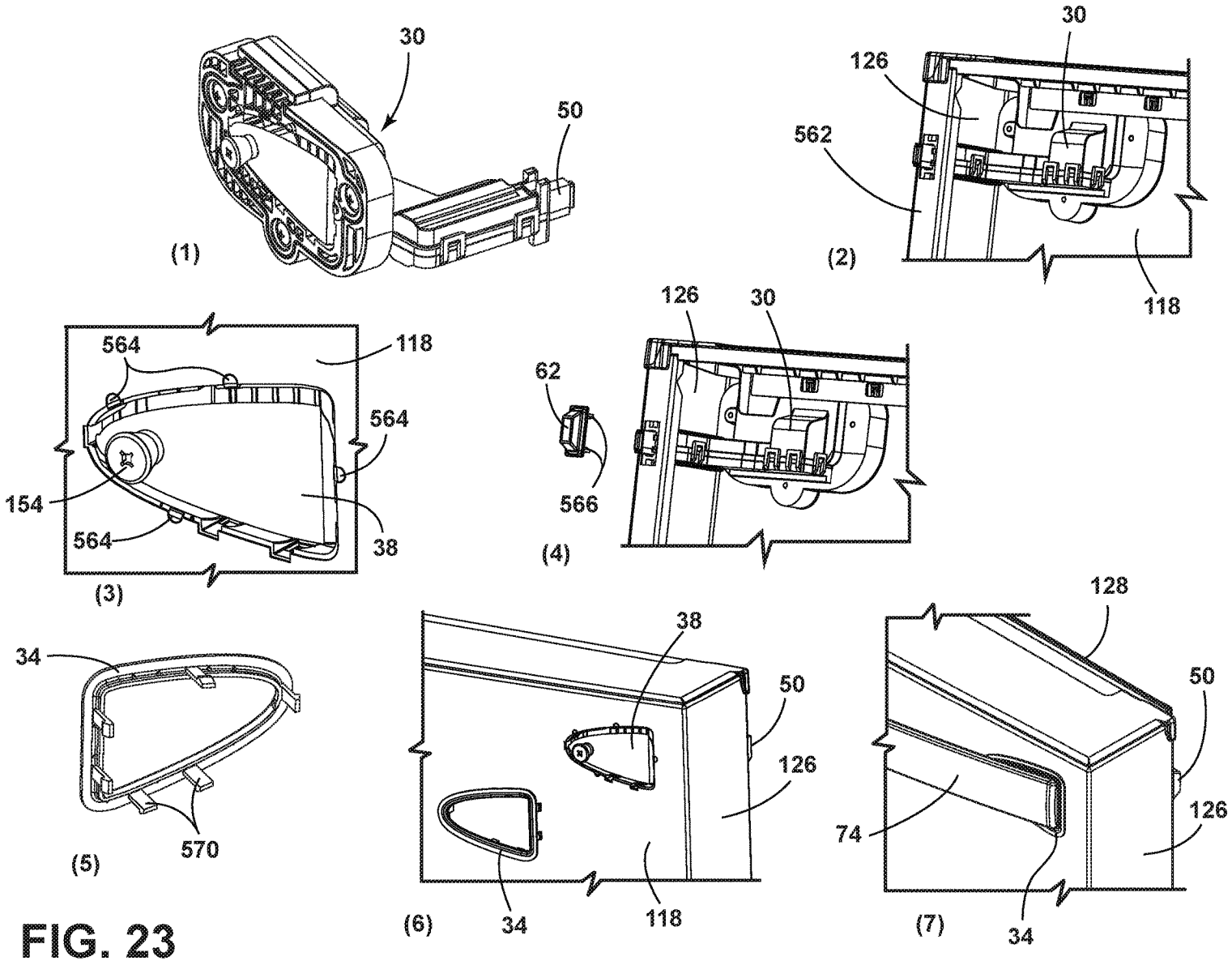
FIG. 23 shows a series of steps regarding a pre-foam assembly method for coupling an open actuator to a door according to one aspect of the present disclosure.

Referring now to FIG. 23, a pre-foam assembly method is shown for coupling the opening actuator 30 to the door 22. First, the opening actuator 30 and its respective components are selected using the modular approach as previously described. Second, the opening actuator 30 is coupled to the door wrapper 118 and the pusher arm 50 is positioned in a door panel 562. Third, a plurality of locators 564 may be coupled to the door wrapper 118 to help maintain the positioning of the opening actuator 30. Forth, the back bezel 62 is coupled to the door panel 562 with one or more snaps 566 provided on the back bezel 62 to help lock the positioning of the opening actuator 30. Fifth, the front bezel 34 has a plurality of snaps 570 that are used to couple the front bezel 34 to the door wrapper 118 further locking the position of the opening actuator 30 as shown in the sixth step. Seventh, the protruding handle 74 is coupled to the opening actuator 30 using the screw lug 154 and the screw lug receiving member 158 (shown in FIG. 7).

Referring to FIGS. 21A to 23, a method for installing the opening actuator 30 in the door 22 is provided. The method includes determining a distance between a pair of mounting holes on the door handle 26, determining a mounting profile for the door handle 26, selecting the casing 42 providing the desired distance between the pair of mounting holes on the door handle 26, selecting the pivot handle plate 38 that can be coupled to the mounting profile of the door handle 26, selecting the front bezel 34 and the intermediate attachment 58 to couple with the pivot handle plate 38 and casing 42, coupling the door handle 26 to the pivot handle plate 38, and coupling the front bezel 34 and the intermediate attachment 58 to the door handle 26 and the casing 42. The actuator mechanism 46 extends and retracts the pusher arm 50 against the front wrapper side 54 of the refrigerator 10.

It is understood that the descriptions outlining and teaching the opening actuator 30 and the modular approach and mounting method previously discussed herein, which can be used in any combination, apply equally well to the method described in FIGS. 21A to 23, where applicable, further disclosing the method for installing the opening actuator 30 in the door 22.

In this specification and the appended claims, the singular forms "a," "an" and "the" include plural reference unless the context clearly dictates otherwise. For the purposes of describing and defining the present teachings, it is noted that the terms "substantially" and "approximately" are utilized herein to represent the inherent degree of uncertainty that may be attributed to any quantitative comparison, value, measurement, or other representation. The term "substantially" and "approximately" are also utilized herein to represent the degree by which a quantitative representation may vary from a stated reference without resulting in a change in the basic function of the subject matter at issue.

It is to be understood that the present disclosure is not limited to the particular embodiments described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A refrigerator comprising:

a refrigerator body having an interior storage space;

a door coupled to the refrigerator body to open and close the interior storage space;

a door handle coupled to the door in a pivotally rotatable manner; and an opening actuator coupled to the door handle wherein the opening actuator applies a force to the refrigerator body to open the interior storage space;

wherein the opening actuator comprises:

a door wrapper of the refrigerator;

a front bezel;

a pivot handle plate of the opening actuator coupled to the door handle;

a casing of the opening actuator enclosing an actuator mechanism and one or more pusher arm that extend and retract against a front wrapper side of the refrigerator body;

an intermediate attachment coupling the pivot handle plate to the casing;

a lever coupled to the pivot handle plate and the one or more pusher arm with a fulcrum near a center of the lever pivoting on a vertical axis; and a back bezel.

2. The refrigerator of claim 1, wherein the door handle is a protruding handle.

3. The refrigerator of claim 1, wherein the door handle is a pocket handle having a top actuation, a linear actuation, or a bottom actuation.

4. The refrigerator of claim 1, wherein the pusher is configured to be linearly retracted from and linearly extended against the front wrapper side of the refrigerator.

5. The refrigerator of claim 1, wherein the pusher is configured to be rotatably retracted from and rotatably extended against the front wrapper side of the refrigerator.

6. The refrigerator of claim 1, wherein the door wrapper comprises a plurality of locators.

7. The refrigerator of claim 6, wherein the front bezel comprises a plurality of snaps coupled to the plurality of locators.

8. The refrigerator of claim 7, wherein the back bezel comprises one or more snaps coupling the back bezel to a door panel of the door.

* * * * *